US006771240B2

(12) United States Patent
Inoue et al.

(10) Patent No.: US 6,771,240 B2
(45) Date of Patent: Aug. 3, 2004

(54) METHOD OF DRIVING MATRIX TYPE DISPLAY APPARATUS, DISPLAY APPARATUS AND ELECTRONIC EQUIPMENT

(75) Inventors: Akira Inoue, Shiojiri (JP); Suguru Yamazaki, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 42 days.

(21) Appl. No.: 09/736,421

(22) Filed: Dec. 15, 2000

(65) Prior Publication Data

US 2002/0126107 A1 Sep. 12, 2002

(51) Int. Cl.[7] ..... G09G 3/36

(52) U.S. Cl. ..... 345/87; 345/204; 345/96; 345/208; 345/209

(58) Field of Search ..... 345/87, 90, 94, 345/97, 99, 204, 96, 208, 209

(56) References Cited

U.S. PATENT DOCUMENTS 4,743,096 A * 5/1988 Wakai et al.
5,248,965 A * 9/1993 Yoshimitsu
5,526,015 A * 6/1996 Tsuboyama et al.
5,606,342 A * 2/1997 Shoji et al.
5,757,349 A * 5/1998 Togashi et al.
6,522,319 B1 2/2003 Yamazaki

* cited by examiner

*Primary Examiner*—Matthew C. Bella
*Assistant Examiner*—Hau Nguyen
(74) *Attorney, Agent, or Firm*—Oliff & Berridge PLC

(57) ABSTRACT

It is to manage both the reduction of power consumption and the enhancement of quality of picture when a partial display operation is performed. A scanning line driving circuit 350 supplies each of scanning lines 312 in a display region with selection signals in a second half part of one horizontal scanning time period and with non-selection signals in the rest thereof by inverting the polarity every vertical scanning time period. Further, the scanning line driving circuit 350 supplies each of scanning lines 312 in a non-display region with non-selection signals by inverting the polarity every one or more vertical scanning time periods. A data line driving circuit 250 supplies each of data lines 212 with a signal representing a positive-side voltage level VDP and a signal representing a negative-side voltage level VDN in first and second half parts of a horizontal scanning time period, respectively, for a period of time of the same length in the case that a scanning line 312 in a display region is selected. Furthermore, the data line driving circuit 250 supplies each of data lines 212 alternately with a signal representing the positive-side voltage level VDP and a signal representing the negative-side voltage level VDN every one or more horizontal scanning time period.

15 Claims, 17 Drawing Sheets

METHOD OF DRIVING MATRIX TYPE DISPLAY APPARATUS, DISPLAY APPARATUS AND ELECTRONIC EQUIPMENT

BACKGROUND OF THE INVENTION

1. Field of Invention

The present invention generally relates to a method of driving a matrix type display apparatus which suppresses an occurrence of degradation in quality of picture and which reduces the power consumption to an extremely low value, and to such a matrix type display apparatus and electronic equipment.

2. Description of Related Art

In display apparatuses used in portable electronic equipment, such as a hand-portable telephone set, the number of display dots has increased year after year so that more information can be displayed on the screen thereof. On the other hand, the portable electronic equipment is battery driven in principle, and thus required to reduce the power consumption thereof as much as possible. Therefore, the display apparatus used in the portable type electronic equipment is required to have two apparently contradictory features, that is, high resolution and low power consumption. Thus, to solve such a problem, an attempt has been made to adapt the display apparatus to perform a full-screen display operation when a high resolution is required, and to display only a partial region of the screen thereof and put the remaining region into a non-display state.

SUMMARY OF THE INVENTION

However, there has occurred a problem that power consumption is ineffectively reduced against all expectation even when only a partial region of the screen of a display apparatus is indicated in the case that a high resolution is not required. Further, the configuring of the display apparatus in such a way as to display only a part of the screen thereof and to put the remaining region of the screen thereof into a non-display state causes another problem in that the circuit of the apparatus is complex.

The present invention is accomplished in view of the aforementioned problems. An object of the present invention is to provide a method of driving a matrix type display apparatus, which can suppress an occurrence of degradation in the quality of picture, enhance the resolution thereof and reduce the power consumption thereof, and simplify the configuration thereof, and to provide a matrix type display apparatus having a driving circuit for performing this a method and to provide electronic equipment having this display apparatus.

To resolve such problems, according to an aspect of the present invention, there is provided a method of driving a pixel provided corresponding to each of intersections between a plurality of scanning lines and a plurality of data lines by a switching device, wherein when only a first region including a part of the plurality of scanning lines is put into a display state while a second region including the rest of the plurality of scanning lines is put into a non-display state, a non-selection signal, in response to which the switching device is brought into a non-conducting state, is supplied to each of the scanning lines of the second region by inverting a polarity of a signal voltage every one or more vertical scanning time period, by using an intermediate value which is represented by the signal supplied to the data lines as a reference.

It is desirable only from the viewpoint of low power consumption that a signal representing the intermediate value of values represented by signals to be supplied to the data lines is supplied to each of the scanning lines belonging to the second region serving as a non-display region. However, with this configuration, it is necessary to additionally select a signal representing a voltage which corresponds to the intermediate value. Thus, the configurations of the voltage generating circuit and the scanning line driving circuit are complex.

In contrast with this, according to the present invention, the non-selection signal is supplied to each of the scanning lines of the second region by inverting the polarity every one or more vertical scanning time periods, on the basis of the intermediate value. Thus, the effective value of the voltage becomes nearly zero. There is no need for generating and selecting a signal representing the voltage which corresponds to the intermediate value. Consequently, the configuration of the circuit is simplified. Furthermore, the voltage level is changed every one or more vertical scanning time periods, more preferably, every time period, which is longer than the vertical scanning time period. Thus, the frequency of the signal supplied to the scanning line is reduced. Consequently, the power consumption resulting from the voltage level changing operation in the circuit for driving the scanning lines is suppressed. Moreover, the power consumption resulting from the charging and discharging of the associated capacity of the scanning lines and the driving circuit is also suppressed.

Further, according to the present invention, preferably, a selection signal, which puts the switching device into a conducting state, is supplied in one of time periods into which a horizontal scanning time period is divided, and a non-selection signal, which puts the switching device into a non-conducting state, is supplied in the remaining ones of the time periods by inverting the polarity of a signal voltage every predetermined time period, by using the intermediate value which is represented by the signal supplied to the data line as a reference. With this configuration, the signal supplied to each of the scanning lines of the first region used as the display region is not different from a signal in an ordinary state in which all the scanning lines are in the display region. This prevents the configuration of the circuit from being complex by changing the duty ratio. Moreover, this prevents the quality of display of the first region from being deteriorated in comparison with that in the ordinary state.

Furthermore, according to the present invention, preferably, the selection signal is supplied to each of the scanning lines before the second region is put into a non-display state. As described above, each of the pixels of the present invention is driven by the switching device. Thus, in the case that a certain one of the pixels is in the second region, the previously written charge is held as it is according to the non-conducting state of the switching device. Consequently, in the case of a transition from the ordinary state, in which the region including all the scanning lines is used as the display region, to the state in which the second region is put into the non-display region, preferably, the apparatus performs a step at which all the pixels included in the second region are once put into an off display condition. The present invention enables the method to include this step.

Further, to achieve the foregoing object, there is provided a method of driving a matrix type display apparatus for driving a pixel provided corresponding to each of intersections between a plurality of scanning lines and a plurality of data lines by a switching device, wherein in the case that only a first region including a part of the plurality of scanning lines is put into a display state while a second region including the rest of the plurality of scanning lines is put into a non-display state, when a scanning line in the second region is selected, a signal having a positive-side voltage level and a negative-side voltage level, which are determined by using an intermediate value represented by a signal to be supplied to the data lines as a reference, is supplied to each of the scanning lines by inverting a polarity of a signal voltage every one or more vertical scanning time period, by using the intermediate value as a reference.

Only from the viewpoint of limiting the power consumption of each of the data lines at the time of selecting the scanning lines of the second region, which is a non-display region, to a low value, it is preferable that a signal representing the intermediate value of the positive-side voltage level value and the negative-side voltage level value is supplied to each of the data lines. However, with this configuration, it is necessary to additionally select a signal representing a voltage which corresponds to the intermediate value, in addition to the positive-side voltage level and the negative-side voltage level. Thus, the configurations of the voltage generating circuit and the scanning line driving circuit are complex.

In contrast with this, according to the present invention, the signal having the positive-side voltage level and the negative-side voltage level is supplied to each of the data lines at the time of selecting the scanning lines of the second region by inverting the polarity every one or more vertical scanning time periods, on the basis of the intermediate value. Thus, the effective value of the voltage becomes nearly zero. There is no need for generating and selecting a signal representing the voltage which corresponds to the intermediate value. Consequently, the configuration of the circuit is simplified. Furthermore, it is sufficient to configure the apparatus so that the voltage level of the voltage to be supplied to the data lines is switched every longer period by inverting the polarity every one or more horizontal scanning time periods, more preferably, every time period, which is longer than the horizontal scanning time period. Thus, the frequency at which the data lines are driven is reduced. Consequently, the power consumption resulting from the voltage level changing operation in the circuit for driving the data lines is suppressed. Moreover, the power consumption resulting from the charging and discharging of the associated capacitance of the circuit and the wirings is also suppressed.

Incidentally, according to the present invention, it is preferable that the polarity inverting period of the positive-side voltage level and the negative-side voltage level at the time of selecting the scanning lines of the second region is a time period whose length is obtained by multiplying the length of the horizontal scanning time period by a value approximately equal to a quotient of the number of the scanning lines of the second region by an integer that is equal to or larger than 2. Thus, when the scanning line of the second region is selected, the time period in which the signal having the positive-side voltage level is supplied is equal in length to the time period in which the signal having the negative-side voltage level is supplied, even during the time period during which the second region is in a non-display state. The effective voltage applied to the pixel put into a non-display state is uniformed in such a manner as to have a value of nearly zero. Incidentally, in the apparatus of the present invention, the length of the polarity-inverting period is maximized by being set at a value that is obtained by multiplying the horizontal scanning time period by a quotient of the number of the scanning lines of the second region by 2. Consequently, the power consumption resulting from the voltage level changing operation in the circuit for driving the data lines is suppressed. Moreover, the power consumption resulting from the charging and discharging of the associated capacity of the circuit and the wirings is also suppressed.

Further, according to the present invention, it is preferable that when the scanning line of the first region is selected, signals relatively having the positive-side voltage level and the negative-side voltage level are alternately supplied to each of the data lines in a time period in which a selection signal putting the switching device into a conducting state is supplied, and a time period in which a non-selection signal putting the switching device into a non-conducting state is supplied, of one horizontal scanning time period correspondingly to the polarity of a voltage represented by the selection signal which is determined by using the intermediate value as a reference. More preferably, the time period in which the signal having the positive-side voltage level is supplied is nearly equal in length to the time period in which the signal having the negative-side voltage level is supplied. With this configuration, when the scanning line of the first region serving as a display region is selected, signals relatively having the positive-side voltage level and the negative-side voltage level are alternately supplied in the time period during which the selection signal is supplied, and the time period during which the non-selection signal is supplied within a horizontal scanning time period, regardless of what pattern is displayed therein. The effective values of the voltages applied to the pixels put in the display state in a holding time period are nearly equal to one another. This prevents an occurrence of a problem that the effective value of the voltage varies according to a change in turning-off leakage current in the holding time period. Consequently, the degradation in quality of picture can be prevented.

Meanwhile, according to the present invention, it is preferable that when the scanning line of the second region is selected before the second region is put into a non-display state, a signal for putting the second region into an off display condition is supplied thereto. As described above, each of the pixels of the present invention is driven by the switching device. Thus, in the case that a certain one of the pixels is in the second region, the previously written charge is held as it is, according to the non-conducting state of the switching device. Consequently, in the case of a transition from the ordinary state in which the region including all the scanning lines is used as the display region, to the state in which the second region is put into the non-display region, preferably, the apparatus performs a step at which all the pixels included in the second region are once put into an off display condition. Thus, the second region can be more reliably put into the non-display state.

Moreover, to achieve the aforementioned object, there is provided a matrix type display apparatus for driving a pixel provided corresponding to each of intersections between a plurality of scanning lines and a plurality of data lines by a switching device. This matrix type display apparatus may include a scanning line driving circuit for supplying a selection signal in response to which the switching device is put into a conducting state, in one of time periods to which a horizontal scanning time period is divided, and a non-selection signal in response to which the switching device is brought into a non-conducting state, in the remaining time periods to each of the scanning lines of the second region by inverting a polarity of a signal voltage every predetermined time period, by using an intermediate value which is represented by the signal supplied to said data lines as a reference, when only a first region including a part of the plurality of scanning lines is put into a display state while a second region including the rest of the plurality of scanning lines is put into a non-display state , and for supplying the non-selection signal to each of the scanning lines of the second region by inverting a polarity of a signal voltage every one or more vertical scanning time period, by using the intermediate value which is represented by the signal supplied to the data lines as a reference, and a data line driving circuit for alternately supplying, when the scanning line of the first region is selected, signals relatively having a positive-side voltage level and a negative-side voltage level, which are determined by using the intermediate value as a reference, in a time period in which the selection signal is supplied, and a time period in which the non-selection signal is supplied, of a horizontal scanning time period correspondingly to a polarity of a voltage represented by the selection signal which is determined by using the intermediate value as a reference, and for supplying, when the scanning line of the second region is selected, the signals relatively having the positive-side voltage level and the negative positive level, which are determined by using the intermediate value as a reference, by inverting the polarity of a signal voltage every one or more horizontal scanning time periods.

The aforementioned effects can be obtained at both the scanning line side and the data line side of the apparatus of the present invention. Therefore, owing to the synergistic effects thereof, the power consumption can be reduced still more. Further, the apparatus of the present invention can prevent an occurrence of degradation in the quality of picture, and enhance the resolution thereof, and simplify the configuration thereof.

Incidentally, according to the present invention, preferably, the scanning line driving circuit alternately inverts the polarities of the voltages represented by the selection signals respectively supplied to adjacent ones of said scanning lines. The current-voltage characteristic of the switching device for driving the pixels in the case of applying a positive-side voltage is slightly different from that of the switching device in the case of applying a negative-side voltage. Thus, the voltage applied to the pixel may vary. However, according to the present invention, the polarity of the selection signal voltage supplied to the adjacent scanning lines is inverted. Moreover, the polarity of the data signal voltage corresponds to the polarity of the selection signal voltage, so that the voltage applied to the pixel placed on the even-numbered scanning line and the voltage applied to the pixel placed on the odd-numbered scanning line are alternately inverted in polarity. Therefore, the display unevenness among the pixels is inconspicuous. Further, the polarity inversion driving frequency is high so that flicker is inconspicuous.

Furthermore, according to the present invention, preferably, the scanning line driving circuit supplies the selection signal to each of the scanning lines before the second region is put into a non-display state. Further, when the scanning line of the second region is selected, the data line driving circuit supplies a signal putting the second region into an off display condition. With this configuration, as described above, in the case of a transition from the ordinary state in which the region including all the scanning lines is used as the display region, to the state in which the second region is put into the non-display region, all the pixels included in the second region are once put into an off display condition. Thus, the second region can be more reliably put into the non-display state.

Meanwhile, according to the present invention, preferably, the data line driving circuit has a memory for storing display data to be respectively displayed at the pixels. When the scanning line of the first region is selected, the data line driving circuit reads the display data from the memory and generates signals respectively having the positive-side voltage level and the negative-side voltage level according to the display data. When the scanning line of the second region is selected, the data line driving circuit stops reading display data from the memory. With this configuration, when the scanning line of the second region is selected, there is no need for displaying display data. According to the present invention, in such a case, the reading of the memory is stopped. Thus, an increase in the power consumption is suppressed. Consequently, the power consumption is reduced still more.

Furthermore, according to the present invention, preferably, the matrix type display apparatus may further include a gray scale level control signal generating circuit for generating a gray scale level control signal. Further, preferably, when the scanning line of the first region is selected, the data line driving circuit supplies display data to pixels placed on the scanning line by modulating the display data so that the modulated display data corresponds to a gray scale level at which data is displayed, at each of the pixels, according to timing provided by the gray scale level control signal. Moreover, preferably, when the scanning line of the second region is selected, the gray scale level control signal generating circuit stops generating a gray scale level control signal, and the data line driving circuit stops modulating the display data. With this configuration, in the case that there is no need for displaying the data, the generation of the gray scale level control signal is stopped. Furthermore, an operation of modulating a signal corresponding to a gray scale level is stopped. Thus, the power consumption is reduced still more.

Further, according to the present invention, preferably, the switching device is a two-terminal switching device. Moreover, preferably, an electro-optical material is sandwiched between a pair of substrates. Furthermore, preferably, each of the pixels is constituted by series-connecting the two-terminal switching device and the electro-optical material between the plurality of scanning lines provided on one of the pair of substrates and the plurality of data lines. The apparatus of the present invention may use a three-terminal device, for instance, a transistor, as the switching device. However, there is the necessity for forming the scanning lines and the data lines in such a way as to intersect one another on one of the substrates. Thus, such an apparatus has a defect in that the likelihood of an occurrence of a short circuit in the wiring is enhanced. Moreover, the manufacturing process is complexed. In contrast, when the two-terminal switching device is used, the scanning lines are formed on one of the substrates, while the data lines are formed on the other substrate. Thus, the apparatus of this configuration has an advantage in that no short circuits are caused in the wiring in principle. Further, the manufacturing process can be simplified as compared with that in the case of using the three-terminal switching device.

Furthermore, according to the present invention, preferably, the twoterminal switching device has a conductor/insulator/conductor structure connected to the scanning line or the data line. The conductor, which is the first layer, can be used as the scanning line or the data line, without any change. Further, the insulator is formed by anodizing this conductor, that is, the first layer. Consequently, the manufacturing process is simplified still more.

Additionally, to achieve the object, there is provided electronic equipment that may include the aforementioned matrix type display apparatus. Therefore, as described above, this electronic equipment can prevent an occurrence of degradation in the quality of picture, and enhance the resolution thereof, and simplify the configuration thereof.

DETAILED DESCRIPTION OF PREFERRED EMBODIMENTS

Hereinafter, an embodiment of the present invention is described with reference to the accompanying drawings.

<Electrical Configuration>

Figure 1:
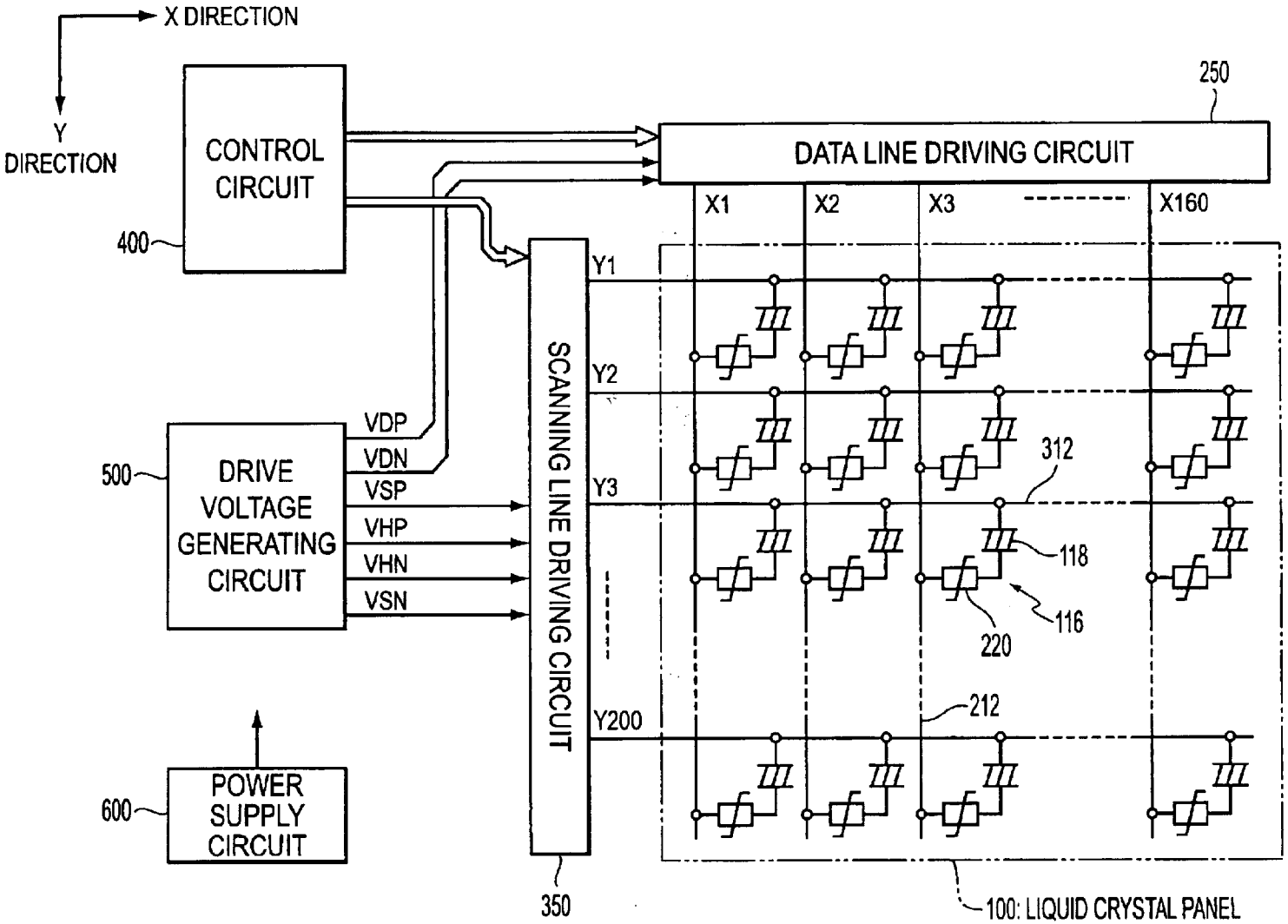
FIG. 1 is a block diagram illustrating the electrical configuration of a display apparatus according to an exemplary embodiment of the present invention.

First, the electrical configuration of a display apparatus according to an embodiment of the present invention is described hereinbelow. FIG. 1 is a block diagram illustrating this electrical configuration. As illustrated in this figure, a liquid crystal panel 100 has a plurality of data lines (or segment electrodes) 212 formed in such a way so as to extend in a column direction (namely, the Y-direction), a plurality of scanning lines (or common electrodes) 312 formed in such a way as to extend in a line direction (namely, the X-direction), and pixels 116 formed respectively corresponding to intersections of the data lines 212 and the scanning lines 312. Further, each of the pixels 116 consists of an electro-optical material (namely, a liquid crystal layer) 118 and a two-terminal switching device 220 (hereunder referred to as a TFD), for example, a TFD (Thin Film Diode), which are series-connected with each other. Incidentally, for convenience of description, in this embodiment, it is assumed that the total number of the scanning lines 312 is 200, and that the total number of the data lines 212 is 160. Thus, this embodiment is described hereinbelow as a 200×160 matrix type display apparatus. However, the present invention is not limited thereto. Further, the data line driving circuit 250 supplies data signals X1 to X160 to the data lines 212. The scanning line driving circuit 350 supplies the scanning signals Y1 to Y200 to the scanning lines 312.

Incidentally, as shown in FIG. 1, the TFD 220 is connected to the side of the data lines 212. The liquid crystal layer 118 is connected to the scanning lines 312. However, the TFD 220 may be connected to the scanning lines 312. The liquid crystal layer 118 may be connected to the data lines 212.

Next, the control circuit 400 supplies various clock signals and a control signal to the data line driving circuit 250 and the scanning line driving circuit 350. Incidentally, the data line driving circuit 250, the scanning line driving circuit 350, and the control circuit 400 are described hereinbelow.

Furthermore, the driving voltage generating circuit 500 generates voltage levels VDP, VDN represented by data signals, and voltage levels VSP, VHP, VHN, VSN represented by scanning signals. Incidentally, the voltage levels VDP, VHP are used in common as the same level. Similarly, the voltage levels VDN, VHN are used in common as the same level. In this embodiment, for convenience of description, these voltage levels are described by using different reference characters. Further, the power supply circuit 600 is operative to supply electric power to the control circuit 400 and the drive voltage generating circuit 500.

<Configuration of Panel>

Figure 2:
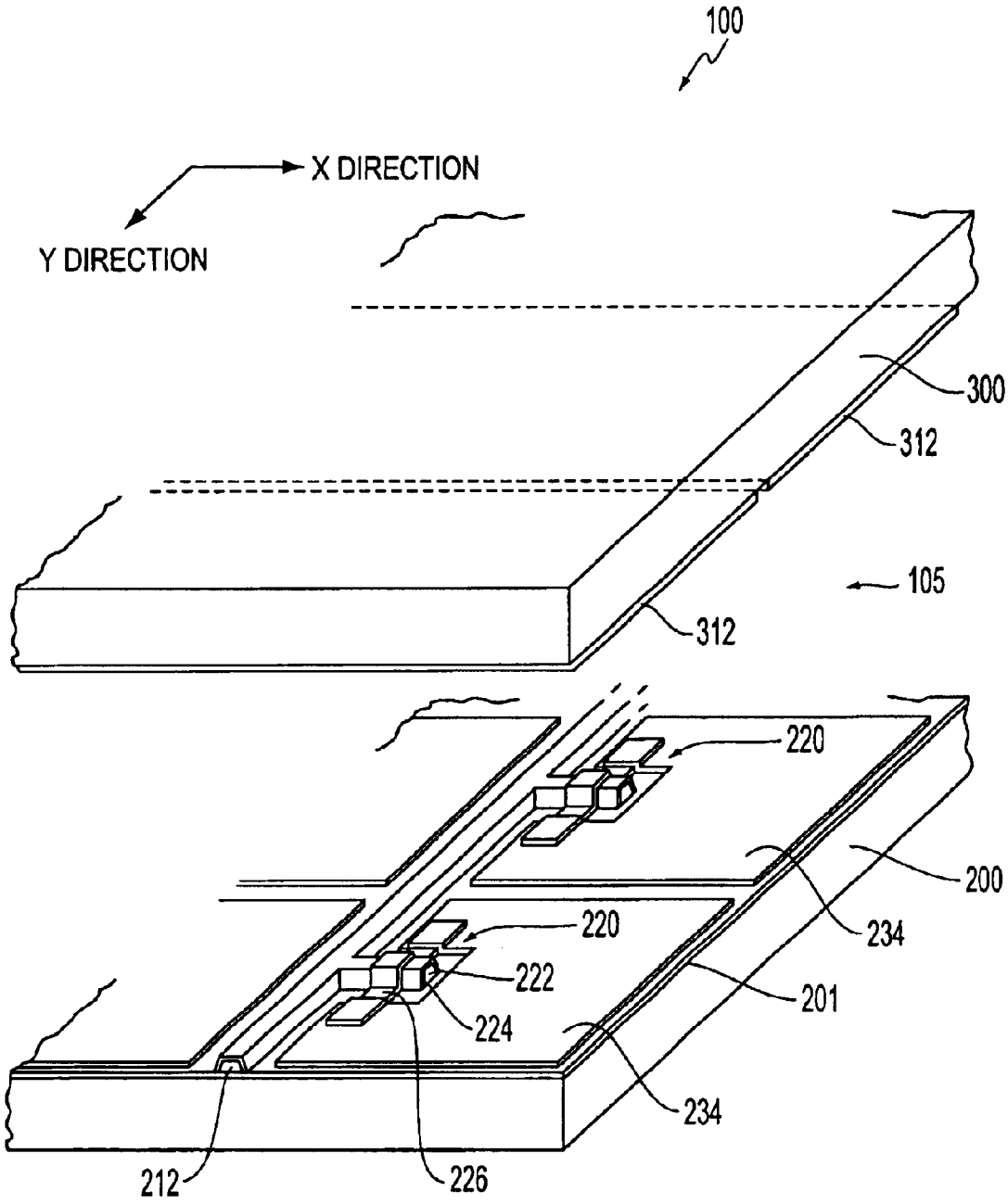
FIG. 2 is a partially cutaway perspective diagram illustrating the configuration of a liquid crystal panel.

Next, the detail configuration of the liquid crystal panel 100 is described hereinbelow. FIG. 2 is a partially cutaway perspective diagram illustrating the configuration of the panel. As illustrated in this figure, the liquid crystal panel 100 has a device substrate 200 and an opposing substrate 300 placed in such a manner as to face the device substrate 200. Between these substrates, pixel electrodes 234 each made of a transparent conductive material, such as ITO (Indium Tin Oxide), are arranged like a matrix on the opposed face of the device substrate 200 in such a manner as to extend in X-direction and Y-direction. Among these electrodes, 200 pixel electrodes 234 arranged in the same column are connected to one of the data lines 212 extending in Y-direction through the TFDs 220. Incidentally, as viewed from the substrate, the TFD 220 may include a first conductor 222 made of tantalum simple substance or tantalum alloy and branched from the data line 212, an insulator 224 obtained by anodizing the first conductor 222, and a second conductor 226, such as chromium. Thus, the TFD 220 has a sandwich structure, that is, a conductor/insulator/conductor structure. Thus, the TFD 220 has a diode switching characteristics according to which the current-voltage characteristics become nonlinear in both the positive direction and the negative direction.

Further, the insulator 201 has transparency and nonconductivity and is provided with the intention of preventing the first conductor 222 from being peeled off by a heat treatment after the deposition of the second conductor 226 and of preventing impurities from being diffused in the first conductor 222. Therefore, in the case that this heat treatment and the impurities present no problems, the insulator 201 can be omitted.

On the other hand, the scanning lines 312 are formed on the opposed surface of the opposing substrate 300 in such a way as to extend in X-direction and to face the pixel electrode 234. Further, the device substrate 200 and the opposing substrate 300 are spaced apart from each other by maintaining a constant interval by the use of a sealing member (not shown) and a spacer (not shown). For example, the liquid crystal 105 of the TN (Twisted Nematic) type is filled into this closed space as an electro-optical material. Thus, the liquid crystal layer 118 shown in FIG. 1 is formed. That is, the liquid crystal layer 118 is formed at each of the intersections between the data lines 212 and the scanning lines 312 and consists of the scanning line 312, the pixel electrode 234, and the liquid crystal 105 sandwiched between both the electrodes.

Thus, with such a configuration, when a selection voltage is applied to the TFD through the scanning line 312 as a scanning signal, the TFD is put into a conducting state. When a data signal is applied to the TFD through the data line 212 when the TFD is in this conducting state, a predetermined amount of charge is stored in the liquid crystal layer connected to the TFD. Even when the TFD is put into a non-conducting state by applying the selection voltage thereto after the charge is stored, the charge stored in the liquid crystal layer is maintained in the case that an amount of (turn-off) leakage current of this TFD is small, and that the resistance of the liquid crystal layer is sufficiently high. Thus, the oriented state of the liquid crystal is changed every pixel by driving each of the TFDs to thereby control the amount of the stored charge. Consequently, predetermined information can be displayed.

Incidentally, the data lines 212 may be replaced with the scanning lines 312. That is, the lines 212 may be used as the scanning lines. Further, the lines 312 may be used as the data lines. Even when the relation between the signal and the wire is interchanged between the scanning line 312 and the data line 212, the display operation can be quite similarly performed.

In addition, color filters arranged in stripes, mosaic, or a triangle are provided on the opposing substrate 300 according to the usage of the liquid crystal panel 100. Moreover, a black matrix made of a metallic material and a resin is provided. Additionally, an oriented film (not shown) rubbed in a predetermined direction is provided on the opposed face of the device substrate 200 and the opposing substrate 300. On the other hand, a deflecting plate (not shown) according to the orientation is provided on each of the substrates 200 and 300.

Incidentally, the oriented film and the polarizer become unnecessary when polymer dispersed liquid crystal, in which fine particles of liquid crystal is dispersed in a polymer, is used in the liquid crystal panel 100. This enhances the efficiency for light utilization. Further, this is advantageous in increasing the luminance of the liquid crystal panel and in decreasing the power consumption thereof. Moreover, in the case that the liquid crystal panel 100 is of the reflecting type, the pixel electrodes 234 may be constituted from a high-reflectance metallic film, such as an aluminum film. Furthermore, the device substrate 200 may be constituted by an opaque semiconductor substrate.

Incidentally, the TFD 220 is an example of the two-terminal switching device. Alternatively, ZnO (zinc oxide) varistor, or MSI (Metal Semi-Insulator) may be used as the two-terminal switching device. Furthermore, the two devices may be series-connected or parallel-connected with each other in opposite direction. This has an advantage in that the diode switching characteristics are symmetrical with respect to a direction perpendicular to both the positive and negative horizontal directions on the same plane.

<Control Circuit>

Figure 3:
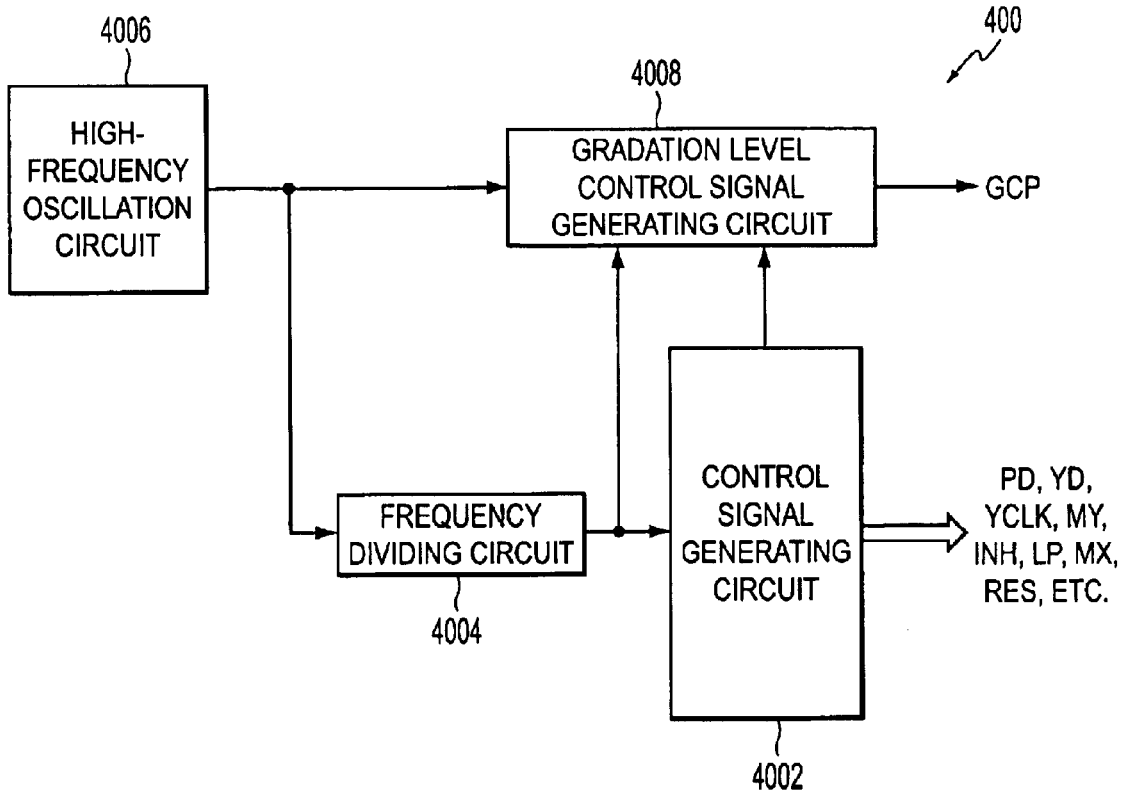
FIG. 3 is a block diagram illustrating the configuration of a control circuit.

Next, the detail configuration of the control circuit 400 is described hereinbelow. FIG. 3 is a block diagram illustrating the configuration of the control circuit 400. In the circuit of this figure, a high-frequency oscillation circuit 4006 is operative to generate high-frequency pulse signals to be used as an oscillation source signal corresponding to a gray scale level timing pulse GCP. Thus, the frequency of the high frequency pulse signal is far higher than that of a low frequency pulse signal for providing a (½) horizontal scanning time period, and is about 3 MHz. Further, a frequency dividing circuit 4004 divides a high frequency pulse signal outputted from the high frequency oscillation circuit 4006 to thereby generate a low frequency pulse signal to be used as a reference for horizontal scanning. Incidentally, in this embodiment, a driving operation is performed by dividing one horizontal scanning time period into a first half time period and a second half time period. This low frequency pulse signal is used for providing a (½) horizontal scanning time period. Therefore, the frequency of the low frequency pulse signal is nearly 30 kHz. The control signal generating circuit 4002 is operative to generate various control signals and clock signals (PD, YD, YCLK, MY, INH, LP, MX, RES) according to the low frequency pulse signal outputted from the frequency dividing circuit 4004.

Figure 10:
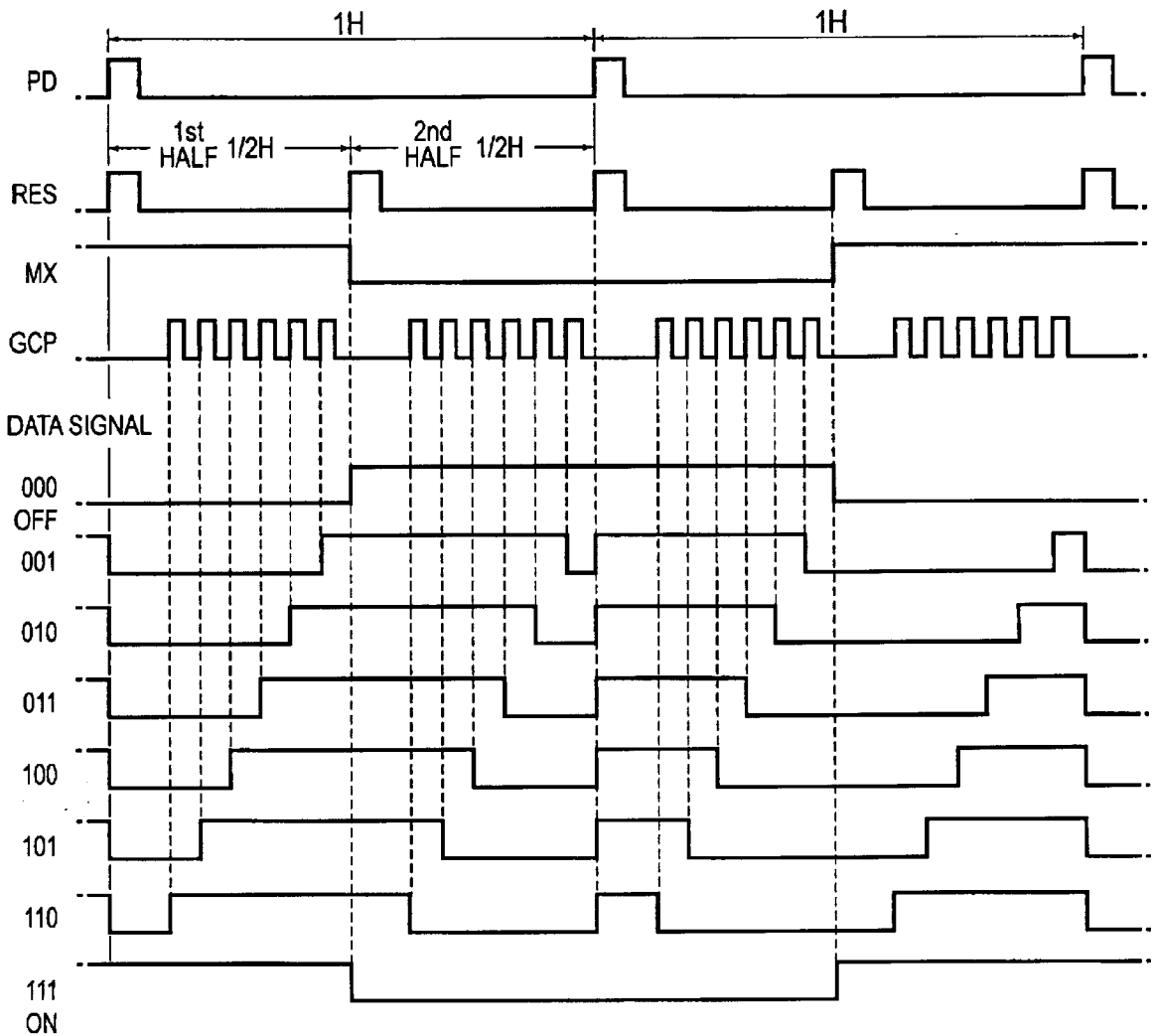
FIG. 10 is a timing chart illustrating an operation of the data line driving circuit.

Incidentally, the gradation level control signal generating circuit 4008 is operative to arrange high frequency pulse signals according to the weight of display data (or the weighted display data) representing gray scale levels in the (½) horizontal scanning time period provided by the low frequency pulse signal that is outputted by the frequency dividing circuit 4004. Thus, the gradation level control signal generating circuit 4008 generates a gray scale timing pulse (or a gray scale level control signal) as shown in FIG. 10. Incidentally, in FIG. 10, the gray scale timing pulse GCP is arranged with equal pitches, for convenience of description. Practically, sometimes, the interval between the pulses is made to be nonuniform in a part of or the entirety of the scanning time period in such a way so as to compensate for the nonlinearity of the light transmittance characteristic (namely, the voltage-transmittance characteristic) of the pixel versus the voltage applied to the liquid crystal through the switching device.

Figure 5:
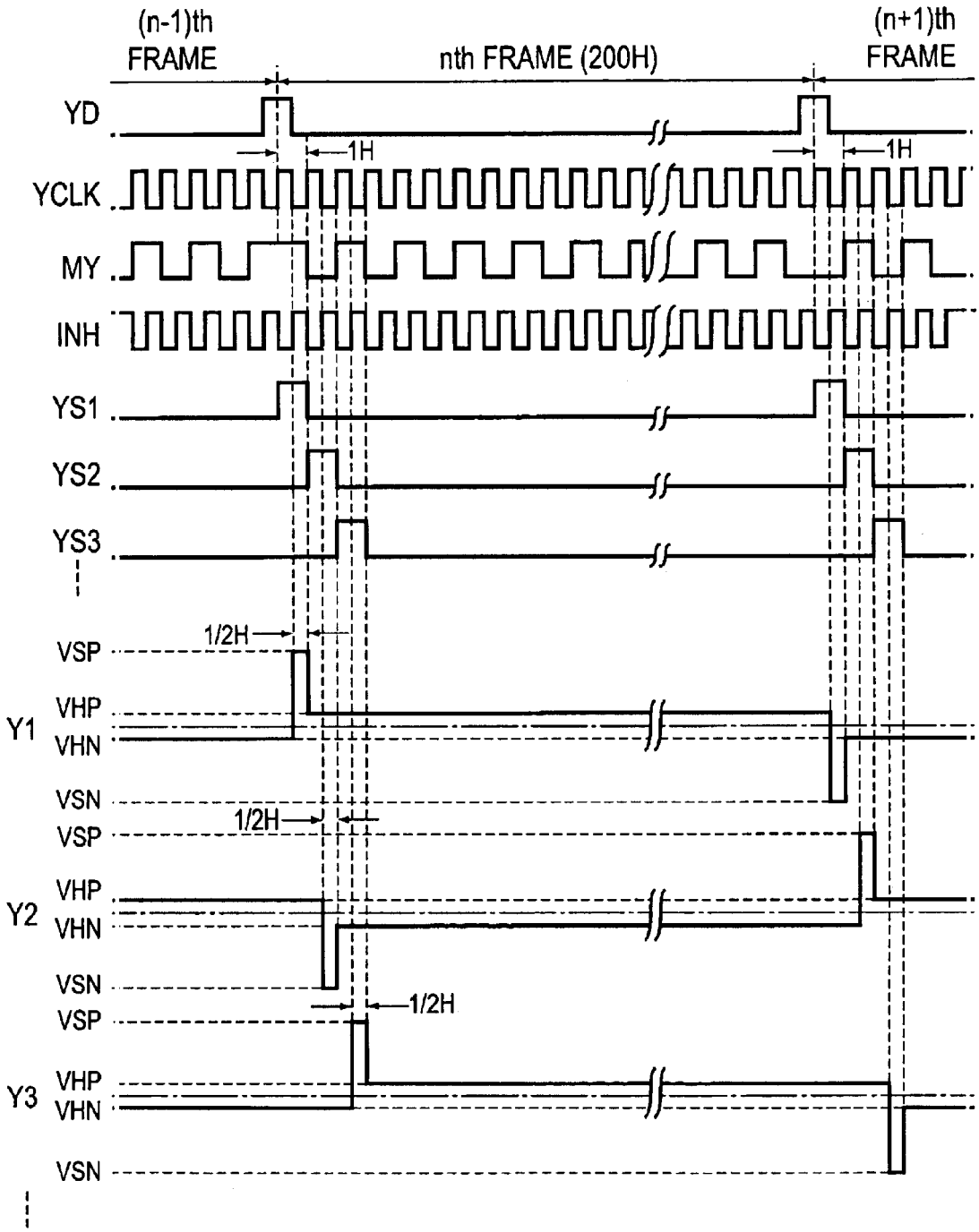
FIG. 5 is a timing chart illustrating an operation of the scanning line driving circuit.

Meanwhile, the control signal generating circuit 4002 generates the following various control signals and clock signals according to the low frequency pulse signal outputted by the frequency dividing circuit 4004. First, in the case that only a region including a certain scanning line 312 is put into a display state, and that a region including the rest of the scanning lines 312 is put into a non-display state (namely, in the case of a partial display), a partial display control signal PD has an H-level only when the scanning line 312 included in the display region is selected, and has an L-level during the other time periods. Second, a start pulse YD is outputted at the beginning of 1 vertical scanning time period (namely, 1 frame) as illustrated in FIG. 5. Third, a clock signal YCLK is a scanning-line-side reference signal. As illustrated in FIG. 5, the clock signal YCLK has a period of 1H that is equivalent to 1 horizontal scanning time period. Fourth, an alternate current driving signal MY is used for performing an alternate current driving operation on the liquid crystal pixel at the scanning line side. As illustrated in FIG. 5, the signal level is reversed every horizontal scanning time period 1H. Moreover, in the horizontal scanning time period in which the same scanning line is selected, the signal level is reversed every frame. Thus, the polarity of the voltage applied to the liquid crystal pixel is inverted every horizontal scanning time period. Furthermore, a driving operation, by which the polarity thereof is inverted every vertical scanning time period, is controlled. Fifth, a control signal INH is used for selecting the second half time period of 1 horizontal scanning time period. As illustrated in FIG. 5, the control signal INH is put into an H active state in this second half time period. Sixth, a latch pulse LP is used for latching data signals at the data-line side, and outputted at the beginning of 1 horizontal scanning time period, as shown in FIG. 10. Seventh, a reset signal RES is used for providing the first half time period and the second half time period of 1 horizontal scanning time period at the data-line side, and outputted at the beginning of each of the first time period and the second time period. Eighth, an alternate current driving signal MX is used for performing an alternate current driving operation on the liquid crystal pixel at the data-line side. As illustrated in FIG. 10, the alternate current driving signal MX maintains the same signal level from the second half time period of a certain horizontal scanning time period 1H to the first half time period of a certain horizontal scanning time period 1H. Thereafter, the signal level thereof is reversed. Incidentally, the signal level of the alternate current driving signal MX in the second half time period of 1 horizontal scanning time period and the signal level of the alternate current driving signal MY in the second half time period thereof are set so that the signal level of the signal MX is obtained by reversing the signal level of the signal MY.

Further, in the case that a partial display control signal PD is at an L-level, the control signal generating circuit 4002 controls and causes the gray scale level control signal generating circuit 4008 to stop the generation of the gray scale timing pulse GCP.

Incidentally, the frequency dividing circuit 4004 may be replaced with a low frequency oscillation circuit so that thus two oscillation circuits may be provided together with the high frequency oscillation circuit 406.

<Scanning Line Driving Circuit>

Figure 4:
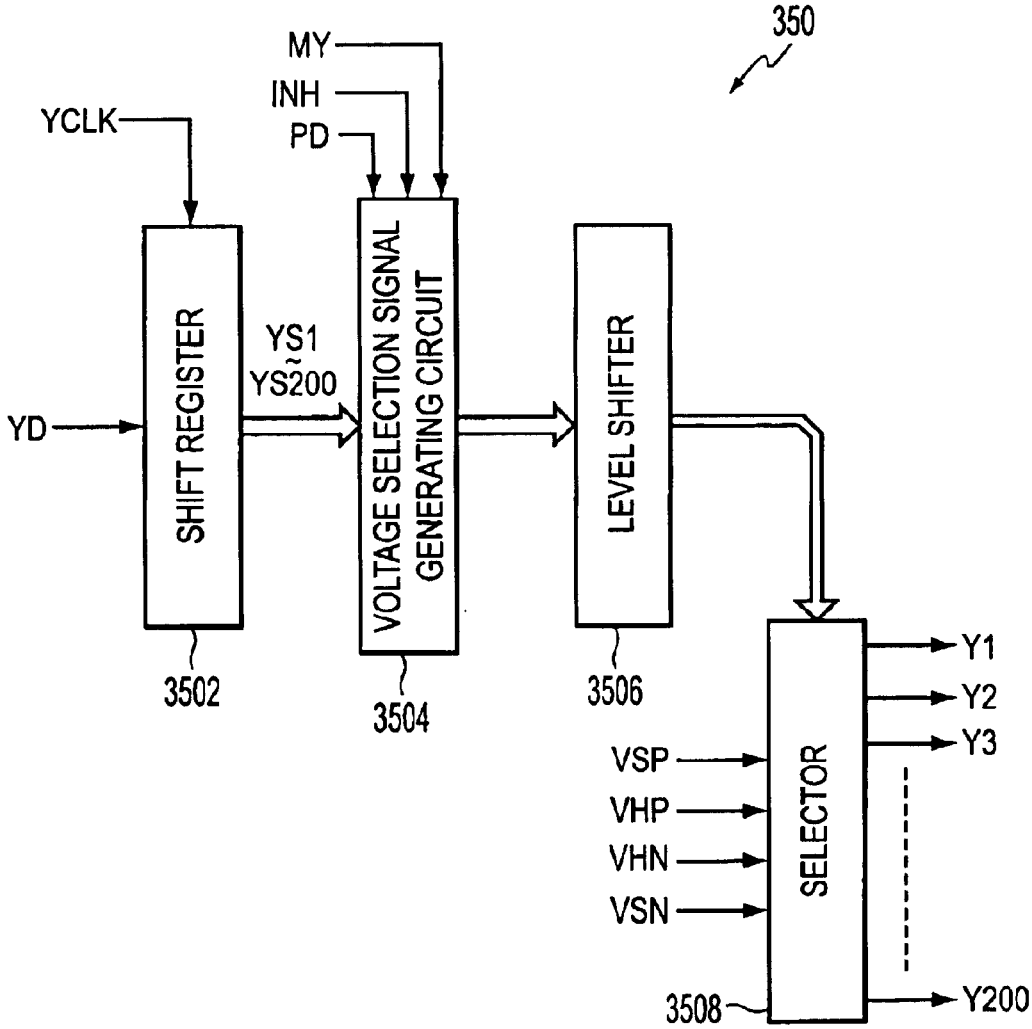
FIG. 4 is a block diagram illustrating the configuration of a scanning line driving circuit.

Next, the detail of the scanning lie driving circuit 350 is described hereinbelow. FIG. 4 is a block diagram illustrating the configuration of this scanning line driving circuit 350. In the circuit of this figure, a shift register 3502 is a 200-bit shift register corresponding to the number of scanning lines, and is operative to sequentially shift a start pulse YD supplied at the beginning of 1 frame according to clock signals YCLK having a period of 1 horizontal scanning time period. Then, the shift register 3502 outputs the shifted pulses as transfer signals YS1, YS2, . . . , YS200. Incidentally, the transfer signals YS1 to YS200 correspond to the scanning lines in a one-to-one correspondence relationship, and indicate which of the scanning lines 312 should be selected.

Subsequently, a voltage selection signal generating circuit 3504 outputs a voltage selection signal used for determining a voltage, which is to be applied to each of the scanning lines 312, from the alternate current driving signal MY and the control signal INH. Incidentally, in this embodiment, the voltage represented by the scanning signals and applied to the scanning lines 312 has the following four kinds of values, that is, VSP (a positive selection voltage), VHP (a positive non-selection voltage), VHN (a negative non-selection voltage), and VSN (a negative selection voltage). Among these values, a time period, during which the selection voltage VSP or VSN is actually applied thereto, is the second half time period of 1 horizontal scanning time period. Further, a non-selection voltage applied thereto after the application of the selection voltage thereto is VHP when the selection voltage is VSP. However, when the selection voltage is VSN, the non-selection voltage is VHN. Thus, the non-selection voltage is uniquely determined according to the selection voltage.

Therefore, when the partial display control signal PD is at an H-level, the voltage selection signal generating circuit 3504 generates the voltage selection signal so that the voltage level indicated by the scanning signal is determined as follows. That is, first, when a transfer signal corresponding to one of the scanning lines is at an H-level and this scanning line is selected, the voltage level of the scanning signal is a selection voltage corresponding to an alternate current driving signal MY in a time period in which the control signal INH is at an H-level (that is, the second half time period of 1 horizontal scanning time period). Second, after the signal level of the control signal INH is changed to an L-level, the signal level of the scanning signal becomes that of the non-selection voltage corresponding to such a selection voltage. Practically, in the case that the alternate current driving signal MY is at an H-level in the time period in which the control signal INH is brought into an H-active state, the voltage selection signal generating circuit 3504 outputs a voltage selection signal for selecting a positive-side selection voltage VSP during such a time period. Thereafter, the circuit 3504 outputs a voltage selection signal for selecting the positive-side non-selection voltage VHP. On the other hand, in the case that the alternate current driving signal MY is at an L-level in such a time period, the circuit 3504 outputs a voltage selection signal for selecting the negative-side selection voltage VSN, during such a time period. Thereafter, the circuit 3504 outputs a voltage selection signal for selecting the negative-side non-selection voltage VHN.

Incidentally, in this embodiment of the present invention, it is determined by employing an intermediate potential level indicated by a signal, which is applied to the data lines as a reference, whether the electric potential to be applied to the scanning lines and the data lines is at a positive-side or negative-side (namely, has a positive polarity or a negative polarity). That is, when the electric potential to be applied thereto is higher than the intermediate value, this electric potential is determined as being at a positive-side. Conversely, when the electric potential to be applied thereto is lower than the intermediate value, this electric potential is determined as being at a negative-side.

Meanwhile, in this embodiment, only the values VHP and VHN are the voltage values of the scanning signal applied to the scanning line 312 included in the non-display region. Thus, when the partial display control signal PD is at an L-level, the voltage selection signal generating circuit 3504 generates a voltage selection signal so that the voltage level of the scanning signal is as follows. That is, first, in the case that the signal level of a transfer signal corresponding to a scanning line becomes an H-level, and thus this scanning line is selected, and that the signal level of the control signal INH becomes an H-level, and thus the second half time period of 1 horizontal scanning time period is selected, the voltage selection signal generating circuit 3504 generates a voltage selection signal so that one of the positive-side non-selection voltage VHP and the negative-side non-selection voltage VHN is reversed to the other thereof.

Meanwhile, the level shifter 3506 increases the voltage magnitude of the voltage selection signal outputted by the voltage selection signal generating circuit 3504. Further, the selector 3508 actually selects the voltage designated by the voltage selection signal, whose voltage magnitude is increased, and outputs such a voltage to a corresponding one of the scanning lines 312.

<Voltage Waveform of Scanning Signal>

Next, the voltage waveform of the scanning signal supplied by the scanning line driving circuit 350 of the aforementioned configuration is studied hereinbelow. First, for convenience of description, it is assumed that a full-screen display operation is performed, namely, that the partial display control signal PD is always at an H-level. In this case, the voltage waveform of the scanning signal is as illustrated in FIG. 5. That is, the start pulse YD is sequentially shifted in the shift register 3502 every horizontal scanning time period 1H according to the clock signal YCLK. Such shifted pulses are outputted as the transfer signals YS1 to YS200. Moreover, the second half time period of 1 horizontal scanning time period 1H is selected by the control signal INH. Furthermore, the selection voltage for the scanning signal is determined according to the level of the alternate current driving signal MY in this second half time period. Thus, the scanning-signal voltage supplied to one scanning line is the positive-side selection voltage VSP when the alternate current driving signal MY is at, for example, an H-level in the second half time period of the horizontal scanning time period in which this scanning line is selected. Thereafter, the positive-side non-selection voltage VHP corresponding to this selection voltage is held. Then, after the lapse of 1 frame, the level of the alternate current driving signal MY is reversed to an L-level in the second half time period of the one horizontal scanning time period. Thus, the voltage level of the scanning signal supplied to this scanning line is the negative-side selection voltage VSN. Thereafter, the negative-side non-selection voltage VHN corresponding to the selection voltage is held. For instance, as illustrated in FIG. 5, the voltage level of the scanning signal Y1 corresponding to the scanning line first selected in an nth frame is the positive-side selection voltage VSP in the second half time period of this horizontal scanning time period. Thereafter, the non-selection voltage VHP is held. At the next (n+1)th frame, the voltage Y1 is the negative-side selection voltage VSN in the second half time period of the first horizontal scanning time period. Thereafter, the negative-side non-selection voltage VHP is held. Thus, the aforementioned cycle is repeated.

Meanwhile, the signal level of the alternate current driving signal MY is reversed every horizontal scanning time period 1H. Thus, the polarity of the voltage represented by the scanning signal supplied to the adjacent scanning line is inverted every horizontal scanning time period 1H. For example, as illustrated in FIG. 5, when the voltage represented by the scanning signal Y1 applied to the scanning line first selected in an nth frame is the positive-side selection voltage VSP in the second half time period of this horizontal scanning time period, the voltage represented by the scanning signal applied to the scanning line secondly selected in this frame is the negative-side selection voltage VSN in the second half time period of this horizontal scanning time period.

Next, the scanning signal in the case of performing a partial display operation is studied hereinbelow. It is assumed herein that the partial display as shown in FIG. 6 is realized, practically, and a pixel region scanned by the first to 40th scanning lines from the top of the liquid crystal panel 100, as viewed in this figure, and a pixel region scanned by 61st to 200th scanning lines are non-display regions, while a pixel region scanned by the 41st to 60th scanning lines is a display region.

Figure 7:
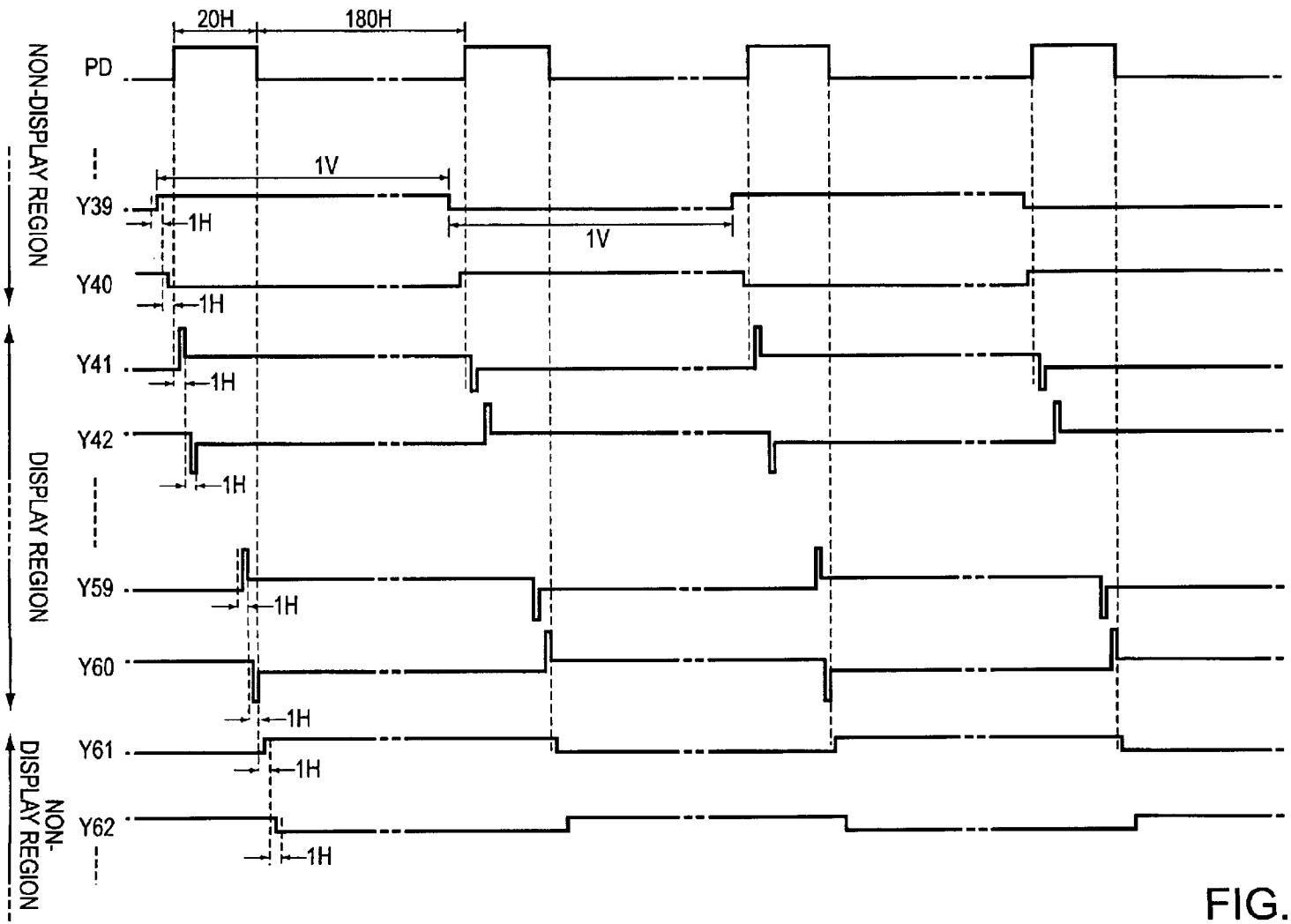
FIG. 7 is a timing chart illustrating the voltage waveform of a scanning signal in the case of a partial display.

Even in the case of the partial display, it is similar to the case of the full-screen display in that the start pulse YD is serially shifted according to the clock signal YCLK every horizontal scanning time period 1H, and in that the shifted pulses are outputted as the transfer signals YS1 to YS200. Incidentally, the partial display control signal PD is at an L-level in 180 horizontal scanning time periods in which 61st to 200 scanning lines in this frame and 1st to 40th scanning lines in the next frame are selected, as illustrated in FIG. 7. Thus, in the 180 horizontal scanning time periods, the levels of the transfer signals YS1 to YS40 and YS61 to YS200 corresponding to these scanning lines are changed to the H-level. When the level of the control signal INH is the H-level, the voltage level of the scanning signals supplied to the 1st to 40th and 61st to 200th scanning lines is changed from the non-selection voltage VHP to the non-selection voltage VHN, alternatively, from VHN to VHP.

On the other hand, the partial display control signal PD is at an H-level in 20 horizontal scanning time periods in total in which the 41st to 60th scanning lines are selected. Thus, the partial display is similar to the full-screen display in the aforementioned respects only in the limited case of the scanning signals supplied to the 41st to 60th scanning lines.

Figure 6:
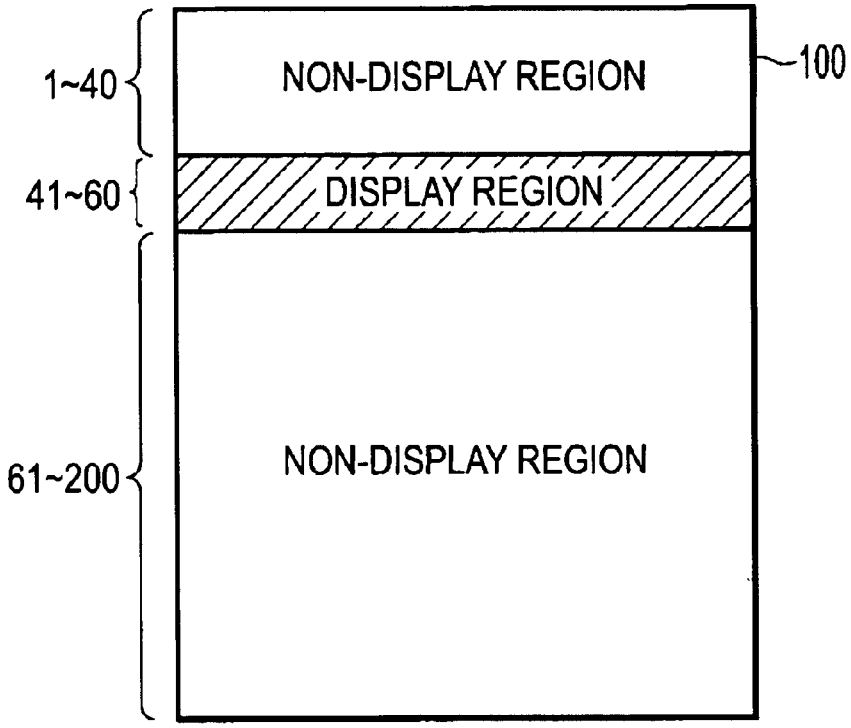
FIG. 6 is a plan diagram illustrating a partial display on a liquid crystal panel.

Therefore, the scanning signals in the case of performing the partial display as illustrated in FIG. 6, especially, the scanning signals supplied to the scanning lines in the vicinity of the border between the non-display region and the display region are as illustrated in FIG. 7. That is, each of the scanning signals Y1 to Y40 and Y61 to Y200 supplied to the 1st to 40th scanning lines and the 61st to 200th scanning lines in the non-display region is changed in voltage value from one of VHP and VHN to the other in the middle of the horizontal scanning time period corresponding to a corresponding scanning line. Thus, in this embodiment, regarding the scanning signal corresponding to a scanning line scanned toward the non-display region, the polarity of the non-selection voltage is inverted every frame.

Incidentally, only from the viewpoint of realizing a low-power-consumption apparatus, it is preferable that the voltage level of the scanning signal corresponding to a scanning line scanned toward the non-display region is an intermediate voltage between the voltages VDP and VDN applied thereto as data signals. However, in this case, not only the generation of an additional intermediate voltage but also the provision of additional bits in the voltage selection signal generated by the voltage selection signal generating circuit 3504 (see FIG. 4) are necessary. Furthermore, the selection range of the selection performed by the selector 3508 is increased. Thus, the configuration of the circuit is complexed. However, there is little difference in configuration between the apparatus according to this embodiment and the conventional apparatus adapted to perform only the full-screen display, so that the configuration of the apparatus is prevented from being complexed. Moreover, the scanning signal corresponding to a scanning line scanned toward the non-display region is generated only by switching the non-selection voltage, which is a low voltage, at extremely long intervals, namely, 1 V corresponding to 1 frame. Thus, in the case of performing the partial display operation, the power consumed by the scanning line driving circuit 350 can be limited to a low value of the power consumption of the apparatus utilizing the supply of the intermediate voltage level of a data signal.

Figure 8:
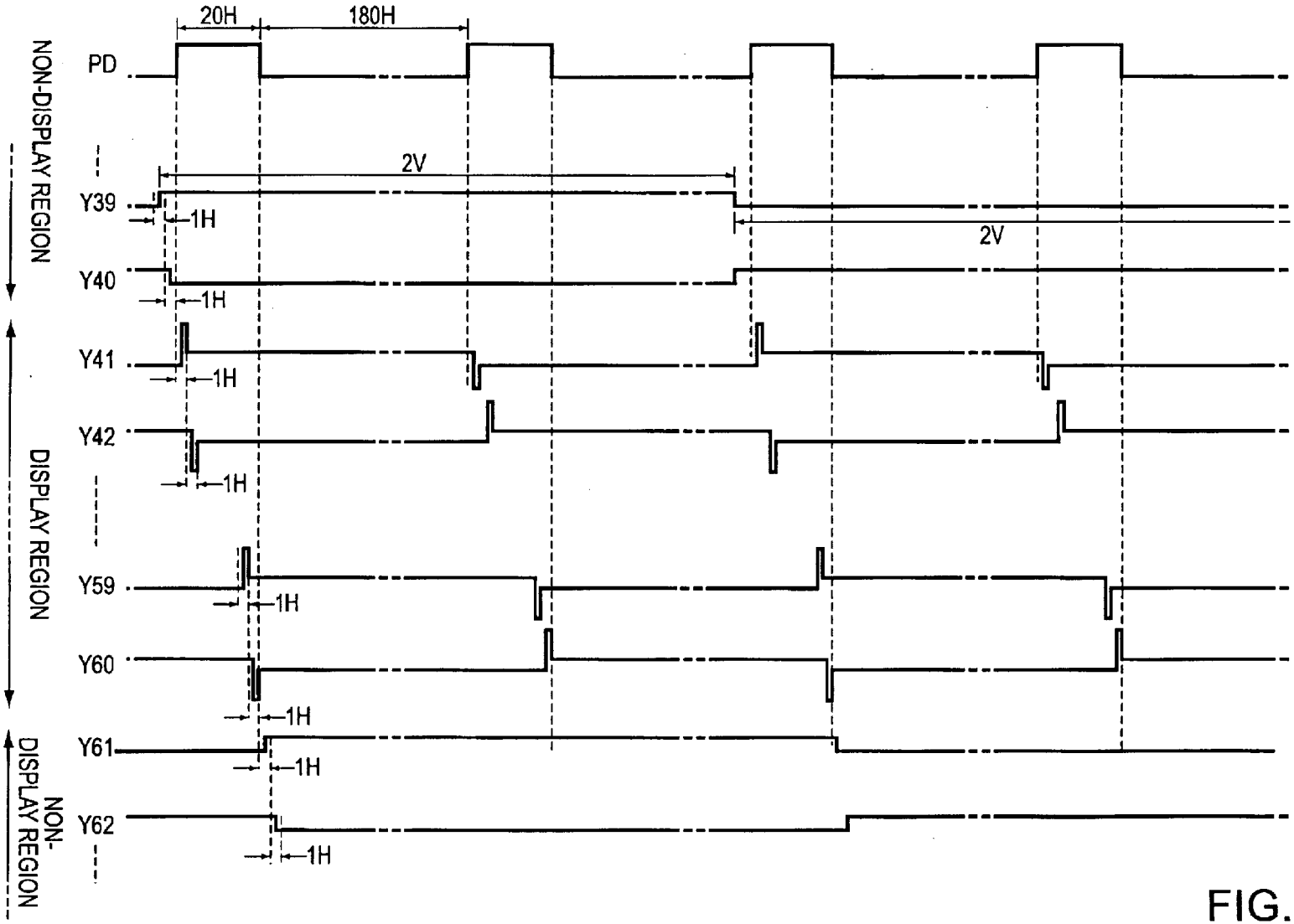
FIG. 8 is a timing chart illustrating the voltage waveform of a scanning signal in the case of a partial display.

Incidentally, the switching interval of the non-selection voltage is 1V corresponding to 1 frame in this embodiment. However, the power consumption caused by the switching is suppressed by setting a longer switching interval. Therefore, the switching interval of the non-selection voltage may be set at 2V corresponding to 2 frames or more, as illustrated in FIG. 8. Incidentally, it is not preferable that the voltage level of the scanning signal corresponding to a scanning line scanned toward the non-display region be fixed to one of the levels of the non-selection voltages VHP and VHN in a display apparatus assumed to be alternate-current-driven.

On the other hand, the voltage level of the scanning signals Y41 to Y60 corresponding to the 41st to 60th scanning lines in the display region is one of the selection voltage levels VSP and VSN in the second half time period of the horizontal scanning time period. Thereafter, the voltage level of these scanning signals is maintained at the level of the non-selection voltage corresponding to this selection voltage. Then, the voltage level of such scanning signals becomes the other of the selection voltages in the second half time period of the horizontal scanning time period after a lapse of 1 frame. Thereafter, the voltage level of such scanning signals becomes the non-selection voltage corresponding to this selection voltage. Thus, such a cycle is repeated. Therefore, there is little difference between the scanning signal supplied to the scanning line in the display region and the scanning signal used in the conventional apparatus adapted to perform only the full-screen display operation. Consequently, in the case of performing the partial display operation, there is not caused inconvenience in that the quality of display is degraded, as compared with the case of performing the full-screen display.

<Data Line Driving Circuit>

Figure 9:
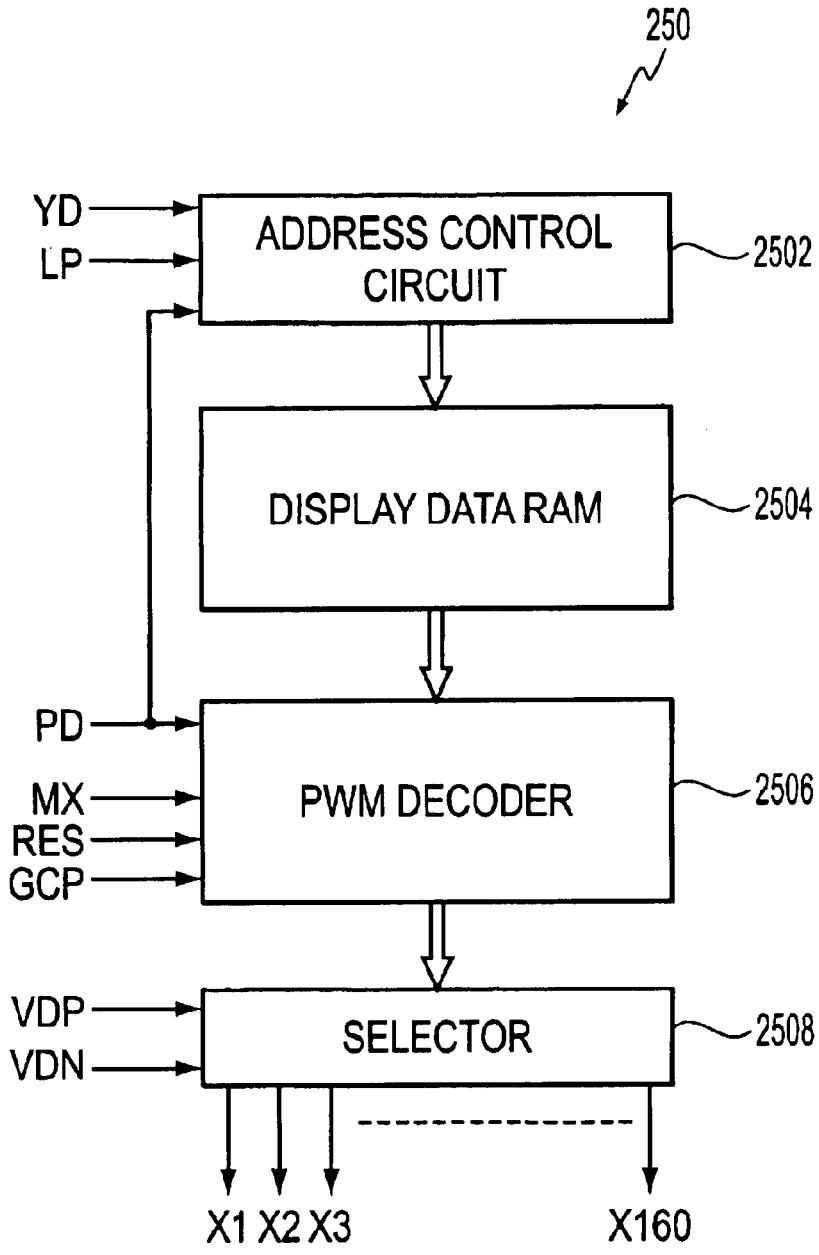
FIG. 9 is a block diagram illustrating the configuration of a data line driving circuit.

Next, the details of the data line driving circuit 250 are described hereinbelow. FIG. 9 is a block diagram illustrating the configuration of this data line driving circuit 250. In this figure, an address control circuit 2502 is provided for generating a row address to be used for reading display data. The row address is reset in response to the start pulse YD first supplied in 1 frame. Moreover, the row address is incremented in response to a latch pulse LP supplied every horizontal scanning time period. Incidentally, when the partial display control signal PD is at an L-level, the address control circuit 2502 inhibits the supply of the row address.

The display data RAM 2504 is a dual port RAM having a storage area that can deal with data of 200×160 pixels. When the data is written thereto, display data supplied from the control circuit 400 is written to a location corresponding to a predetermined address. On the other hand, when the data is read therefrom, display data of 1 line is read from a location designated by the row address.

Subsequently, a PWM decoder 2506 is provided for performing pulse width modulation of a data signal according to the corresponding gray scale level. A voltage selection signal for selecting the voltage level of the data signals X1 to X160 is generated according to the display data on each of the data lines 212 from the alternate current driving signal MX, the reset signal RES, and the gray scale timing pulse GCP. Incidentally, in this embodiment, the voltage represented by the data signal applied to the data lines 212 has two values, that is, VDP (which is a positive-side data voltage) and VDN (which is a negative-side data voltage). Further, the display data is 3 bits in length (which can designate 8 gray scale levels) in this embodiment.

Thus, when the voltage level of the partial display control signal PD is at an H-level, the PWM decoder 2506 generates voltage selection signals so that the voltage level of the data signal is established as follows. That is, first, the voltage level of the data signal is made by the reset signal RES supplied at the beginning of 1 horizontal scanning time period to be at a level obtained by inverting the voltage level of the alternate current driving signal MX. Second, at the leading edge of the gray scale timing pulse GCP, the order of which corresponds to the display data, the PWM decoder 2506 generates voltage selection signals such that the voltage level of the data signal is inverted to the same level as of the alternate current driving signal MX. FIG. 10 illustrates the display data signal which is inputted to the PWM decoder 2506 in binary notation, and a voltage selection signal obtained by decoding the display data signal. Incidentally, the PWM decoder 2506 generates a voltage selection signal such that when the display data is (000), the voltage level of the data signal is equal to that of the alternate current driving signal MX, and that when the display data is (111), the voltage level of the data signal is equal to a level obtained by inverting that of the alternate current driving signal MX.

On the other hand, when the partial display control signal PD is at an L-level, the PWM decoder 2506 generates a voltage selection signal so that the voltage level of the data signal is inverted from one of the positive-side data voltage level VDP and the negative-side data voltage VDN to the other voltage level every time period whose length is obtained by dividing the length of the time period, during which the signal PD is at the L-level, by a certain even number, regardless of the display data. Incidentally, in this embodiment, the even number is set at 6.

Actually, the PWM decoder 2506 has a counter for counting the gray scale timing pulses GCP and a coincidence detecting circuit for detecting the coincidence between the count value of this counter and the display data read from the display data RAM 2504, and for changing the level of the voltage selection signal with the coincidence timing.

The selector 2508 actually selects the voltage designated by the voltage selection signal, which is generated by the PWM decoder 2506, and supplies the selected voltage to each of the corresponding data lines 212. The voltage selection signal is a signal representing a binary level. Thus, one of the voltages VDP and VDN is selected according to the voltage level of the voltage selection signal. Thus, the selection of the voltage VDP is switched to the selection of the voltage VDN, and vice versa, with timing provided by the gray scale timing pulse GCP corresponding to the display data. The pulse width of the data signal is changed according to the display data by performing this switching operation within a predetermined time period ((½)H). Consequently, the effective value of the voltage supplied to the liquid crystal changes. This enables the gray scale display of the data.

<Voltage Waveform of Data Signal>

Next, the data signal supplied by the data line driving circuit 250 of the aforementioned configuration is studied hereinbelow. First, for convenience of description, it is assumed that the full-screen display operation is performed, that is, that the partial display control signal PD is always at an H-level. In this case, the voltage waveform of the data signal Xi ("i" is an integer satisfying the condition $1 \leqq i \leqq 160$) is obtained as illustrated in FIG. 10. That is, when the display data is other than (000) and (111), the voltage level of the data signal Xi is reset to the level obtained by inverting the voltage level of the alternate current driving signal MX, in response to the reset signal RES supplied at the beginning of 1 horizontal scanning time period according to the voltage selection signal generated by the PWM decoder 2506. Moreover, the voltage level of the data signal Xi is inverted to the same level as of the alternate current driving signal MX at the leading edge of the gray scale timing pulse GCP, the order of which corresponds to the display data. Incidentally, when the display data is (000), the voltage level of the data signal Xi is changed to a level obtained by inverting the voltage level of the alternate current driving signal MX. On the other hand, when the display data is (111), the voltage level of the data signal Xi is changed to the same level as the voltage level of the alternate current driving signal MX. Thus, as is understood from the figure, the time period in which the voltage level of the data signal Xi is the positive-side voltage VDP is equal in length to the time period in which the voltage level of the data signal Xi is the negative-side voltage VDN, within a time period 1H equivalent to 1 horizontal scanning time period, irrespective of the display data.

Further, in the second half time period of the 1 horizontal scanning time period, the signal level of the alternate current driving signal MX providing the polarity of the voltage represented by the data signal is set at a level obtained by inverting the level of the alternate current driving signal MY providing the polarity of the scanning signal. Thus, it is understood that the data signal Xi corresponds to the polarity of the scanning signal.

Next, the data signal Xi in the case of performing the partial display operation is studied hereinbelow. In this case, it is assumed that the partial display as illustrated in FIG. 6 is performed. In this case, the partial display control signal PD is at an H-level in 20 horizontal scanning time periods, in which the 21st to 40th scanning lines are selected, in total, as illustrated in FIG. 1. On the other hand, the partial display control signal PD is at an L-level in 180 horizontal scanning time periods, in which the 1st to 40th and the 61st to 200th scanning lines are selected, in total.

Among these time periods, in the time periods in which the partial display control signal PD is at the H-level, that is, the time periods in which the scanning lines included in the display region are selected, the display can be regarded as being substantially the same as the full-screen display. Thus, the voltage level of the data signal Xi is determined according to the alternate current driving signal MX and the display data. The region a shown in (a) of FIG. 11 indicates such a fact. Therefore, regarding such a data signal Xi, the time period in which the voltage level of the data signal Xi is the positive-side data voltage VDP is equal in length to the time period in which the voltage level of the data signal Xi is the negative-side data voltage VDN.

Figure 11A:
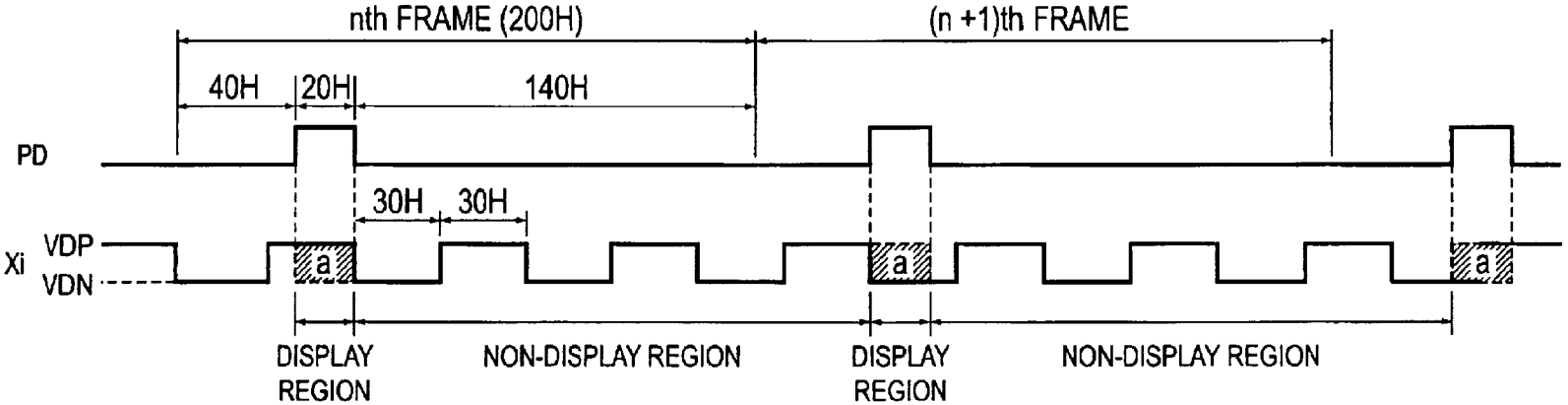
FIG. 11 is a timing chart illustrating the voltage waveform of a data signal in the case of a partial display.
Figure 11B:
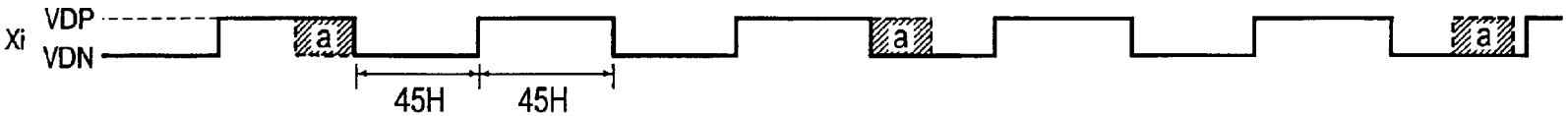
Figure 11C:
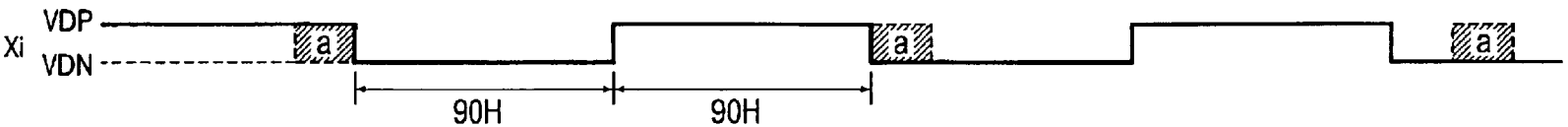

On the other hand, in the time period in which the partial display control signal PD is at an L-level, that is, in the time period in which the scanning lines included in the non-display region are selected, the voltage level of the data signal Xi is changed by the PWM decoder 2506 from one of the positive-side data voltage VDP and the negative-side data voltage VDN to the other as illustrated in (a) of FIG. 11, every 30 horizontal scanning time periods obtained by dividing the 180 horizontal scanning time period by "6", regardless of the display data.

Thus, it is understood that even in the time period in which the partial display control signal PD is at the L-level, the time period in which the voltage level of the data signal Xi is the positive-side voltage VDP is equal in length to the time period in which the voltage level of the data signal Xi is the negative-side voltage VDN, within a time period 1H equivalent to 1 horizontal scanning time period. Therefore, the effective value of the voltage level of the data signal is almost zero in the time period during which the scanning lines included in the non-display region are selected.

Incidentally, only from the viewpoint of realizing the low power consumption apparatus, it is desirable that the voltage level of the data signal Xi in the time period in which the scanning lines in the non-display region are selected is an intermediate voltage value between the positive-side data voltage VDP and the negative-side data voltage VDN. However, in the apparatus of this configuration, not only the generation of an additional intermediate voltage by the drive voltage generating circuit 500 (see FIG. 1), but also the provision of additional bits in the voltage selection signal generated by the PWM decoder 2506 (see FIG. 9), are necessary. Furthermore, the selection range of the selection performed by the selector 2508 is increased. Thus, the configuration of the circuit is complex. However, there is little difference in configuration between the apparatus according to this embodiment and the conventional apparatus adapted to perform only the full-screen display, so that the configuration of the apparatus is prevented from being complex. Moreover, the data signal Xi in the time period in which the scanning lines included in the non-selection region are selected are generated only by switching between the positive-side data voltage VDP or the negative-side data voltage VDN every 30 horizontal scanning time periods, which is extremely longer than the interval in the case of selecting the scanning lines included in the display region. Therefore, in the case of performing the partial display operation, the power consumed by the data line driving circuit 250 can be limited to a low value of the power consumption of the apparatus utilizing the supply of the intermediate voltage level of a data signal.

Furthermore, in the case that the partial display control signal PD is at an L-level, the address control circuit 2502 is inhibited from supplying row addresses in this embodiment, as described above. Incidentally, in the time period during which the partial display control signal PD is at the L-level, no display data is displayed in this time period. Thus, display data is unnecessary. Thus, although the apparatus may be adapted so that the PWM decoder 2506 simply disregards the display data read from the display data RAM in the time period in which the partial display control signal PD is at the L-level, the power consumption for reading the display data is suppressed by positively inhibiting the supply of the row addresses as in this embodiment.

Similarly, in the time period in which the partial display control signal PD is at the L-level, no display data is displayed in this time period. Thus, the gray scale timing pulse GCP is unnecessary. Therefore, it is sufficient that the PWM decoder 2506 is adapted to disregard the gray scale timing pulse GCP. However, as described above, the gray scale timing pulse GCP is obtained by arranging highfrequency pulse signals, which are generated by a high-frequency oscillation circuit 4006, in time series in (½) horizontal scanning time period according to the weight of the display data representing the gray scale level. Therefore, the frequency of the pulse GCP is far higher than those of other clock signals and control signals, which are used as a reference for the horizontal scan in the (½) horizontal scanning time period. Thus, it is often that the power consumption due to the capacitance of the wirings cannot be neglected.

In contrast with this, according to the present invention, in the case that the partial display control signal PD is at the L-level, as described above, the control signal driving circuit 4002 (see FIG. 3) positively causes the gray scale level control signal generating circuit 4006 to stop the generation of the gray scale timing pulse GCP. Thus, the power consumption due to the capacitance of the wirings and the power consumption by the operation performed according to the gray scale timing pulse GCP can be suppressed.

Incidentally, in this embodiment, when the partial display control signal PD is at the L-level, the interval, at which the voltage level of the data signal Xi is inverted, is obtained by dividing a length of the time period, which is obtained by the time period when the partial display control signal PD is at the L-level, by "6". However, the length of such a time period may be divided by an even number that is larger than 6 and that is smaller than 6.

Figure 12:
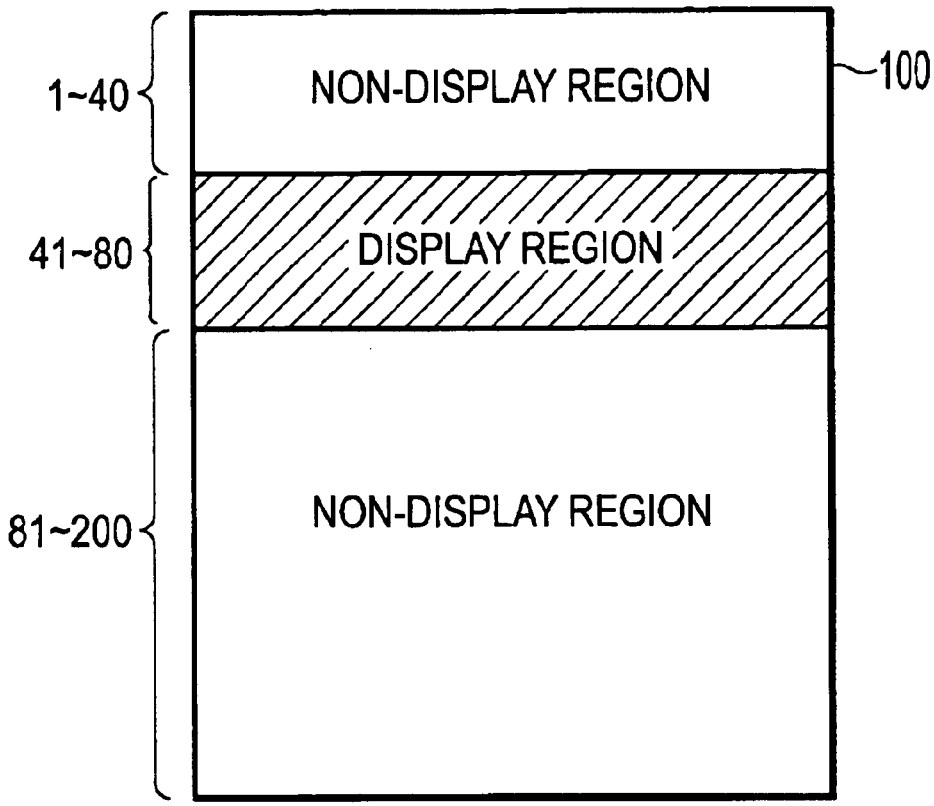
FIG. 12 is a plan diagram illustrating a partial display on a liquid crystal panel.
Figure 13A:
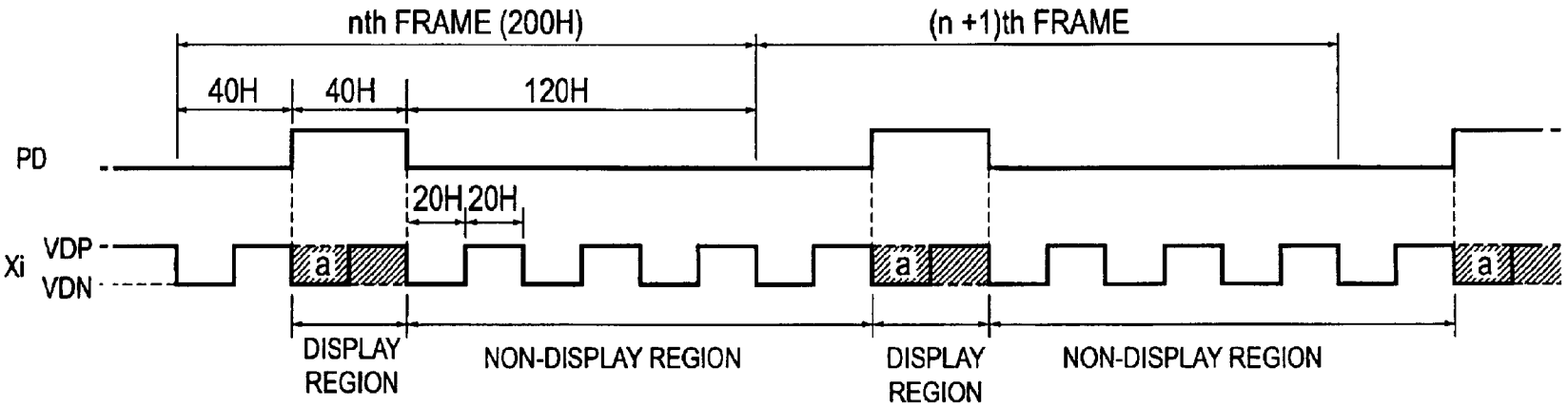
FIG. 13 is a timing chart illustrating the voltage waveform of a data signal in the case of a partial display.
Figure 13B:
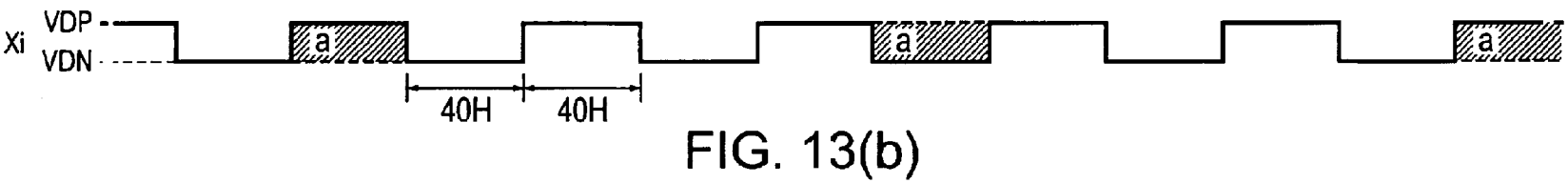
Figure 13C:
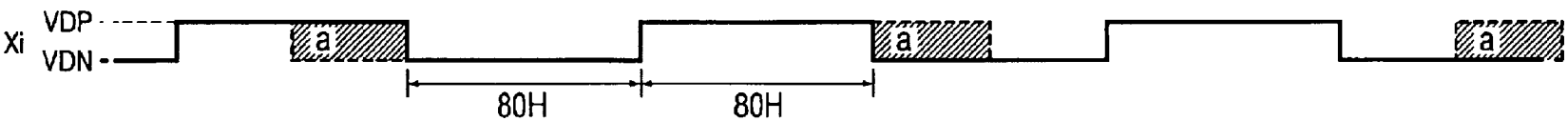

For example, in the case of performing the partial display as illustrated in FIG. 12, the partial display control signal PD is at the L-level in 160 horizontal scanning time periods in total, in which the first to 40th scanning lines and the 81 st to 200th scanning lines are selected, in 1 frame, as illustrated in FIG. 13. In this case, as illustrated in (a) of FIG. 13, the voltage level of the data signal Xi may be changed from one of the positive-side data voltage VDP and the negative-side data voltage VDN to the other thereof every 20 horizontal scanning time periods obtained by dividing the 160 horizontal scanning periods by "8".

Alternatively, for instance, the voltage level of the data signal Xi may be inverted every predetermined time periods obtained by dividing the 160 horizontal scanning time periods by "4", as illustrated in (b) of FIG. 11 or FIG. 13. Alternatively, the voltage level of the data signal Xi may be inverted every predetermined time periods obtained by dividing the 160 horizontal scanning time periods by "2", as illustrated in (c) of FIG. 11 or FIG. 13. Incidentally, the most suitable divisor is "2" from the viewpoint of satisfying the condition where the time period, in which the voltage level of the data signal is the level of the positive-side data voltage VDP, is nearly equal in length to the time period in which the voltage level of the data signal is the level of the negative-side data voltage VDN, and from the viewpoint of minimizing the number of inversions.

Meanwhile, even in the case that the number of horizontal scanning periods, in which the partial display control signal PD is at the L-level, is indivisible by an even number, for example, 179 horizontal scanning periods, it is preferable that the time period in which the voltage level of the data signal is the level of the positive-side data voltage VDP is made to be close in length to the time period in which the voltage level of the data signal is the level of the negative-side data voltage VDN, as much as possible. For example, it is preferable that the time period, in which the voltage level of the data signal is the level of the positive-side data voltage VDP, is set at, for example, 90 horizontal scanning time periods, and the time period, in which the voltage level of the data signal is the level of the negative-side data voltage VDN, is set at, for instance, 89 horizontal scanning time periods. Alternatively, in this case, the time period in which the voltage level of the data signal is the level of the positive-side data voltage VDP is first set at 90 horizontal scanning time periods, and the time period in which the voltage level of the data signal is the level of the negative-side data voltage VDN is first set at 89 horizontal scanning time periods. Thereafter, the former time period may be interchanged with the latter time period. That is, the time period in which the voltage level of the data signal is the level of the positive-side data voltage VDP is set at 89 horizontal scanning time periods, and the time period in which the voltage level of the data signal is the level of the negative-side data voltage VDN is set at 90 horizontal scanning time periods.

<Waveform of Voltage Applied to Pixel>

Figure 14:
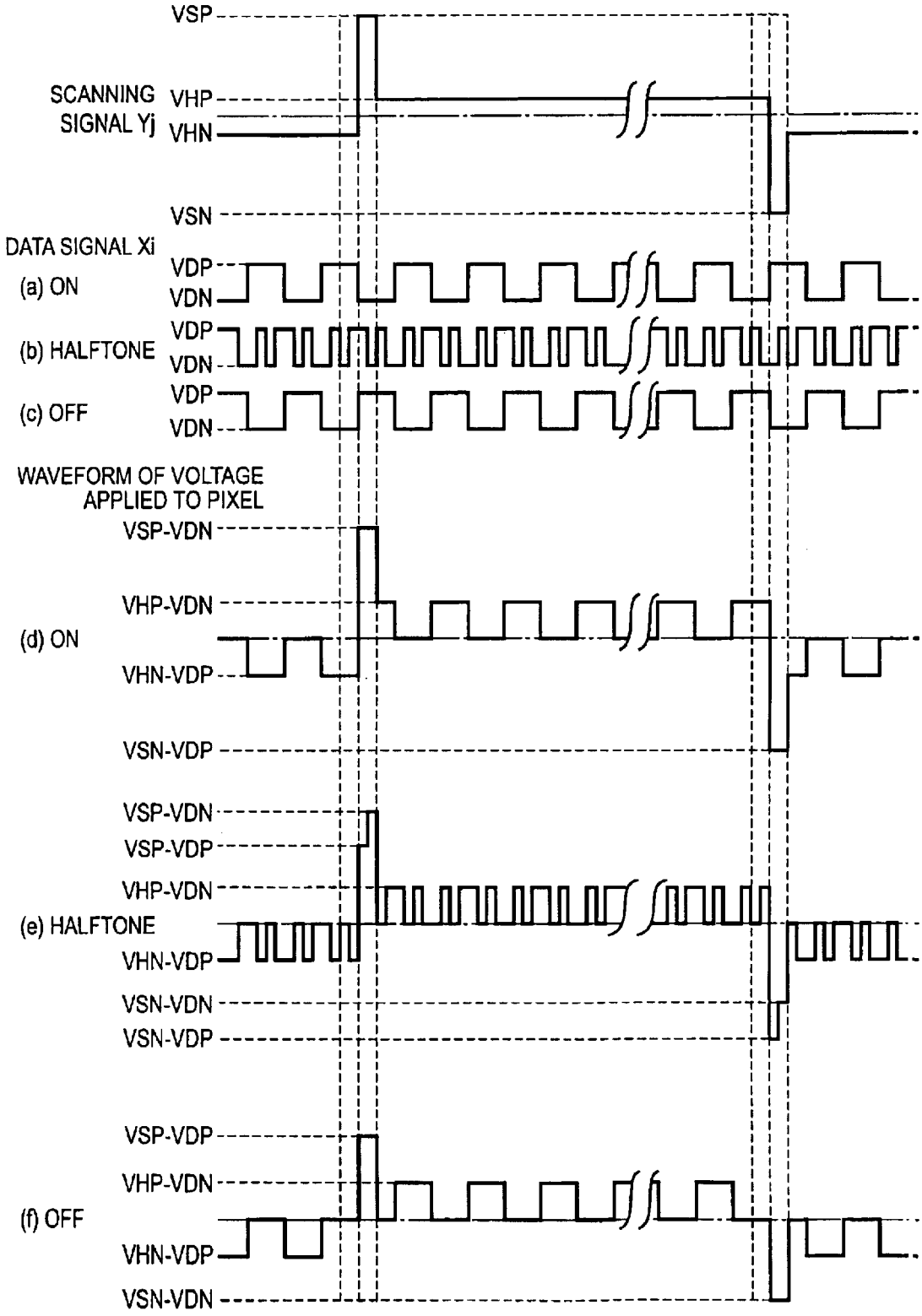
FIG. 14 is a timing chart illustrating the waveform of a voltage applied to a pixel.

Next, the voltage waveform of the voltage actually applied to the pixel 116 is described with reference to FIG. 14. First, when the partial display control signal PD is at an H-level, the voltage level of a scanning signal Yj ("j" is an integer meeting the condition that $1 \leqq j \leqq 200$) is the positive-side selection voltage VSP in the second half time period of the horizontal scanning time period. Thereafter, the positive-side non-selection voltage VHP is held. After a lapse of 1 frame, the level of the scanning signal Yj is the negative-side selection voltage VSN in the second half time period of the next one horizontal scanning period. Thereafter, the negative-side non-selection voltage VHP is held. Such a cycle is thence repeated, as illustrated in FIG. 14. On the other hand, in the case that the display data are, for example, ON-data (111), HALFTONE-data (100) and OFF-data (000), the data signals Xi corresponding such display data are as illustrated in (a), (b), and (c) of FIG. 14, when the partial display control signal PD is at the H-level. These respects are as described above. Therefore, the voltage waveform of the voltage actually applied to the pixel 116 is obtained by subtracting that of the data signal Xi from that of the scanning signal Yj. Thus, the resultant voltage waveforms are as illustrated in (d), (e), and (f) respectively corresponding to the ON-data, HALFTONE-data, OFF-data of the display data.

Incidentally, the data signal Xi is supplied so that the time period in which the voltage level of the data signal is the level of the positive-side data voltage VDP is equal in length to the time period in which the voltage level of the data signal is the level of the negative-side data voltage VDN. Thus, in the holding time period (time period other than the corresponding horizontal scanning time period), the effective values of the voltages applied to the pixels are equal to one another, regardless of how the display data changes. Thus, a ratio of a charge discharged from the charge written to the liquid crystal layer 118, which is owing to the leakage from the TFD 220, to the written charge is uniform over all the pixels 116. This holds for in this embodiment, regardless of the level of the partial display control signal PD. Therefore, the charges written to the pixels, at which should have the same density, are similarly reduced (or discharged) until the next writing of charges thereto, irrespective of what patterns are displayed. Consequently, even when a specific pattern is displayed, the quality of display can be prevented from being degraded.

Further, as described above, the TFD 220 has non-linear current-voltage characteristics in both the positive direction and the negative direction. However, sometimes, such a characteristic at the positive polarity side differs from the characteristic at the negative polarity side. Thus, in this embodiment, the polarities of the voltage represented by the scanning signals are inverted correspondingly to each pair of corresponding adjacent scanning lines. Moreover, the polarity of the voltage represented by the data signal is made to correspond to that of the voltage represented by the scanning signal. Thus, the pixel placed on the even-numbered scanning line and the pixel placed on the odd-numbered scanning line alternately blink. Consequently, flicker is inconspicuous.

<Transition from Full-screen Display Mode to Partial Display Mode>

Heretofore, the relation between the scanning signals and the data signals, which correspond to the scanning lines and the data lines put in the display region and the non-display region, has been described above. Hereinafter, a transition from a full-screen display mode, in which data is displayed by using all the scanning lines, to a partial display mode, in which the data is displayed by using only a part of the scanning lines, is described hereinbelow.

As described above, the selection voltage is not provided to the scanning lines included in the non-display region as the voltage represented by the scanning signal. Thus, the non-conducting state of the TFD 220 is maintained. On the other hand, in the non-conducting state, there is little leakage current from the switching device, such as the TFD 220. Therefore, the charge once written to the liquid crystal layer is held for a long term, even in the case that the switching device is in the non-conducting state. Thus, when the display apparatus is suddenly changed from an ordinary full-screen display mode to a partial display mode, the charge written thereto in the full-screen display mode is held, even when the region to which the charge is written becomes a non-display region. Consequently, the data still remains displayed in a region that should be changed to a non-display region. Moreover, in such a region, a direct current component still remains applied to the liquid crystal.

Thus, it is preferable that at the transition from the full-screen display mode to the partial display mode, all the pixels included in the non-display region are put into an off-state before the partial display is performed. Hereunder, the practical waveform of the signal corresponding to such a pixel is described with reference to FIG. 15. Incidentally, it is assumed herein that the partial display as illustrated in FIG. 6 is performed. Further, the scanning signals Y39 and Y40, which correspond to the scanning lines included in a region that continues to serve as the display region, and the scanning signals Y41 and Y42, which correspond to the scanning lines adjoining those corresponding signals Y39 and Y40 and included in a non-display region, are assumed to represent all the scanning signals Y1 to Y200.

Figure 15:
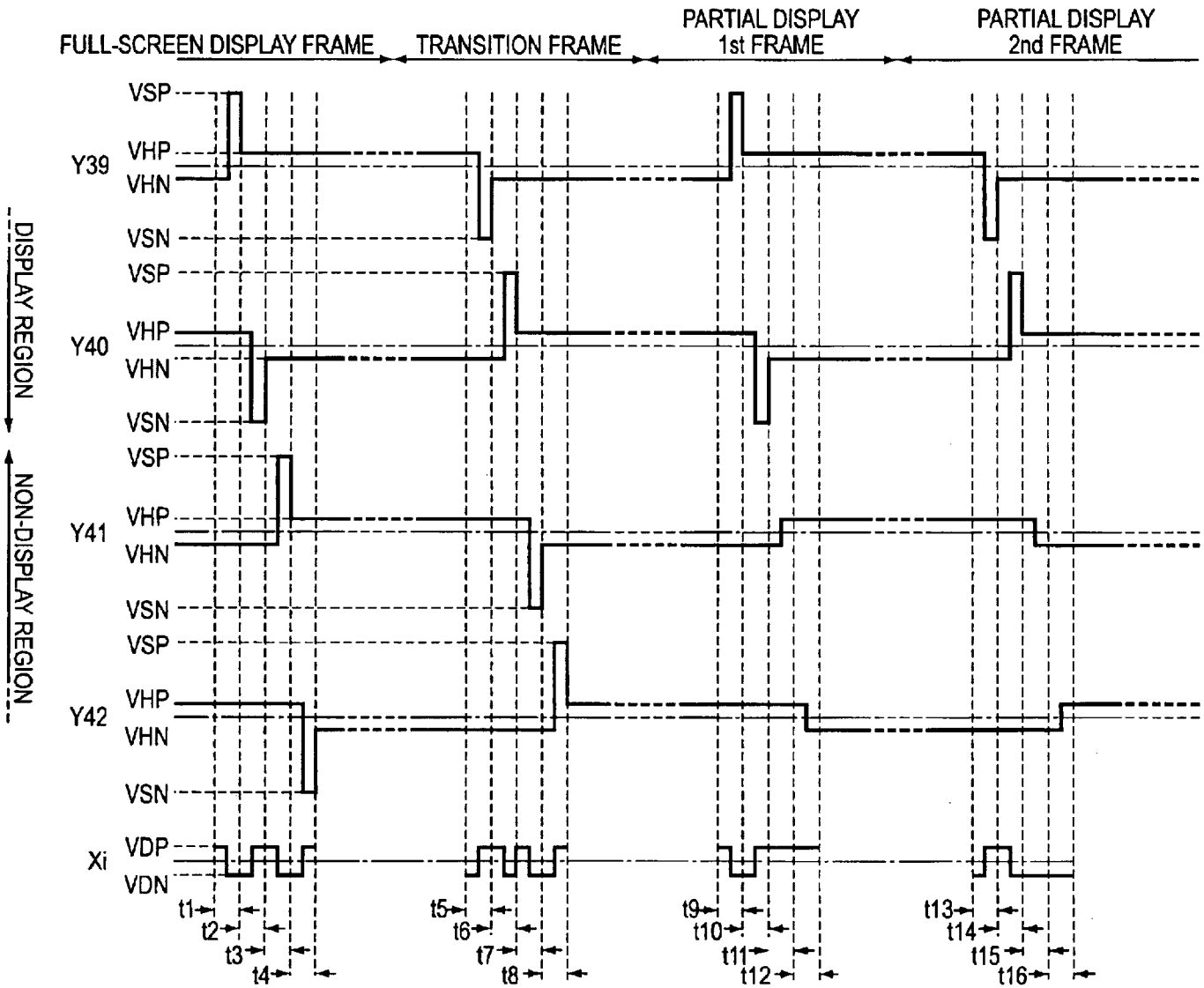
FIG. 15 is a timing chart illustrating an operation performed at a transition from a full-screen display mode to a partial display mode.

As illustrated in FIG. 15, in a frame in which the full-screen display is performed, the voltage level of each of the scanning signals is first changed to that of one of the selection voltages VSP and VSN in the second half time period of the corresponding horizontal scanning time period. Thereafter, the scanning signals are held at the non-selection voltage corresponding to this selection voltage. Moreover, the scanning signals corresponding to the adjacent scanning lines are supplied by maintaining the relation according to which the polarities thereof are inverted from each other. On the other hand, the data signals Xi correspond to the display data according to the polarities of the voltages indicated by the scanning signals (in FIG. 15, all the scanning signals corresponding to the display data are illustrated in such a manner as to be in an ON-state).

For example, in a horizontal scanning time period t1 (t2) in which the selection voltage of the positive polarity (or the negative polarity) is supplied to 39th (or 40th) scanning line, the data signal Xi corresponds to the display data of the positive polarity (or the negative polarity). On the other hand, even in a horizontal scanning time period t3 (t4) in which the selection voltage of the positive polarity (or the negative polarity) is supplied to 41st (or 42nd) scanning line, the data signal Xi corresponds to the display data of the positive polarity (or the negative polarity).

Next, in a frame whose display mode is changed from the full-screen display mode to the partial display mode, not only the scanning signals corresponding to the scanning lines which are included in the region remaining a display region, but also the scanning signals which are included in the region becoming a non-display region, are supplied to the corresponding scanning lines, similarly as in the case of the frame on which the full-screen display is performed. Incidentally, data represented by the data signal Xi in the case of selecting the scanning line included in the non-display region is made to be OFF-data corresponding to the polarity of the corresponding scanning signal, regardless of the display data.

For example, in a horizontal scanning time period t5 (t6) in which the selection voltage of the negative polarity (or the positive polarity) is supplied to 39th (or 40th) scanning line included in the region remaining a display region, the data signal Xi corresponds to the display data of the negative polarity (or the positive polarity). On the other hand, even in a horizontal scanning time period t7 (t8) in which the selection voltage of the positive polarity (or the negative polarity) is supplied to 41st (or 42nd) scanning line included in the region becoming a nondisplay region, the data signal Xi corresponds to the OFF-data of the negative polarity (or the positive polarity). Thus, in the case of the pixels included in the region becoming a non-display region, the charges written thereto in the full-screen display are discharged therefrom.

Further, in the first frame on which the partial display is performed, the scanning signals corresponding to the scanning lines included in the display region are supplied to the corresponding scanning lines, similarly as in the case of the frame on which the full-screen display is performed. However, the voltages represented by the scanning signals corresponding to the scanning lines included in the non-display region are one of the non-selection voltages VHP and VDP, as described above. Further, when the scanning lines included in the region becoming the display region are selected, the data signal Xi corresponds to the display data of the polarity corresponding to the polarity of the voltage represented by the corresponding scanning signals. However, in the case that the scanning lines are selected in the region becoming the non-display region, the voltage level of the corresponding data signal is changed from the level of one of the voltages VDP and VDN to that of the other voltage, every plural horizontal scanning time periods, as described above.

For instance, in a horizontal scanning time period t9 (t10) in which the selection voltage of the positive polarity (or the negative polarity) is supplied to 39th (or 40th) scanning line included in the display region, the data signal Xi corresponds to the display data of the positive polarity (or the negative polarity). On the other hand, even in a horizontal scanning time period t11 (t12) in which the selection voltage of the positive polarity (or the negative polarity) is supplied to 41st (or 42nd) scanning line, the voltage level of the data signal Xi maintains at the level of the voltage VDP.

Incidentally, in the second frame on which the partial display is performed, only the inversion of the polarity is performed. That is, in a horizontal scanning time period t13 (t14) in which the selection voltage of the negative polarity (or the positive polarity) is supplied to 39th (or 40th) scanning line included in the display region, the data signal Xi corresponds to the display data of the negative polarity (or the positive polarity). On the other hand, even in a horizontal scanning time period t15 (t16) corresponding to 41st (or 42nd) scanning line included in the non-display region, the voltage level of the data signal Xi maintains at the level of the voltage VDN.

Thus, when the transition of the display mode from the full-screen display mode to the partial display mode is performed, OFF-data is written to the pixels included in the region becoming a non-display region to thereby discharge the charges having written thereto. This solves the problems caused when the partial display is performed. Incidentally, in this description, it is assumed that the frame whose display mode is changed from the full-screen mode to the partial display mode is only 1 frame. Needless to say, the transition from the full-screen display mode to the partial display mode may occur in one or more frames. However, it is unfavorable from the viewpoint of power consumption that the transition from the full-screen display mode to the partial display mode occurs over an excessively long time period.

<Other Modifications>

Although the pixels 116 are driven by using a transparent insulative substrate made of, for example, glass as the device substrate 200 of the liquid crystal panel 100, and then forming a two-terminal switching device, such as a TFD, in the aforementioned embodiment, the present invention is not limited thereto. For example, the pixel 116 may be driven by TFTs (Thin Film Transistors), each obtained by forming a silicone thin film on such a substrate and further forming a source, a drain, and channels in this thin film. Alternatively, the drive device for the pixels 116 may be, for example, an insulating gate field effect transistor that is obtained by employing a semiconductor substrate as the device substrate 200, and forming a source, a drain and channels on the surface of this semiconductor substrate. In this case, each of the pixel electrodes 234 is constituted by a reflective electrode made of a metal, such as aluminum, and is used as of the reflection type. Moreover, the device substrate 101 may be either a transparent substrate or a substrate of the reflection type obtained by employing pixel electrodes 234 each made of a reflective metal.

Incidentally, in the case of the apparatus adapted to drive the pixels 116 by transistors, both the data lines 212 and the scanning lines 312 should be formed on the device substrate 200 in such a way as to intersect with one another, instead of forming only the data lines 212 or only the scanning lines 312 thereon. Thus, such an apparatus has defects in that the likelihood of an occurrence of a short circuit in the wiring is enhanced, and that the manufacturing process is complexed because the configuration of a TFT itself is more complex than that of a TFD.

Furthermore, in the foregoing description of the embodiment, the display apparatus using liquid crystal as the electro-optical material has been described by way of example. However, the present invention can be applied to a display for displaying an image by utilizing the electro-optical effect, for instance, an electroluminescent display, a fluorescent character display tube, and a plasma display. That is, the present invention can be applied to all electro-optical apparatuses, each having a configuration similar to that of the aforementioned liquid crystal display apparatus.

<Electronic Equipment>

Figure 16:
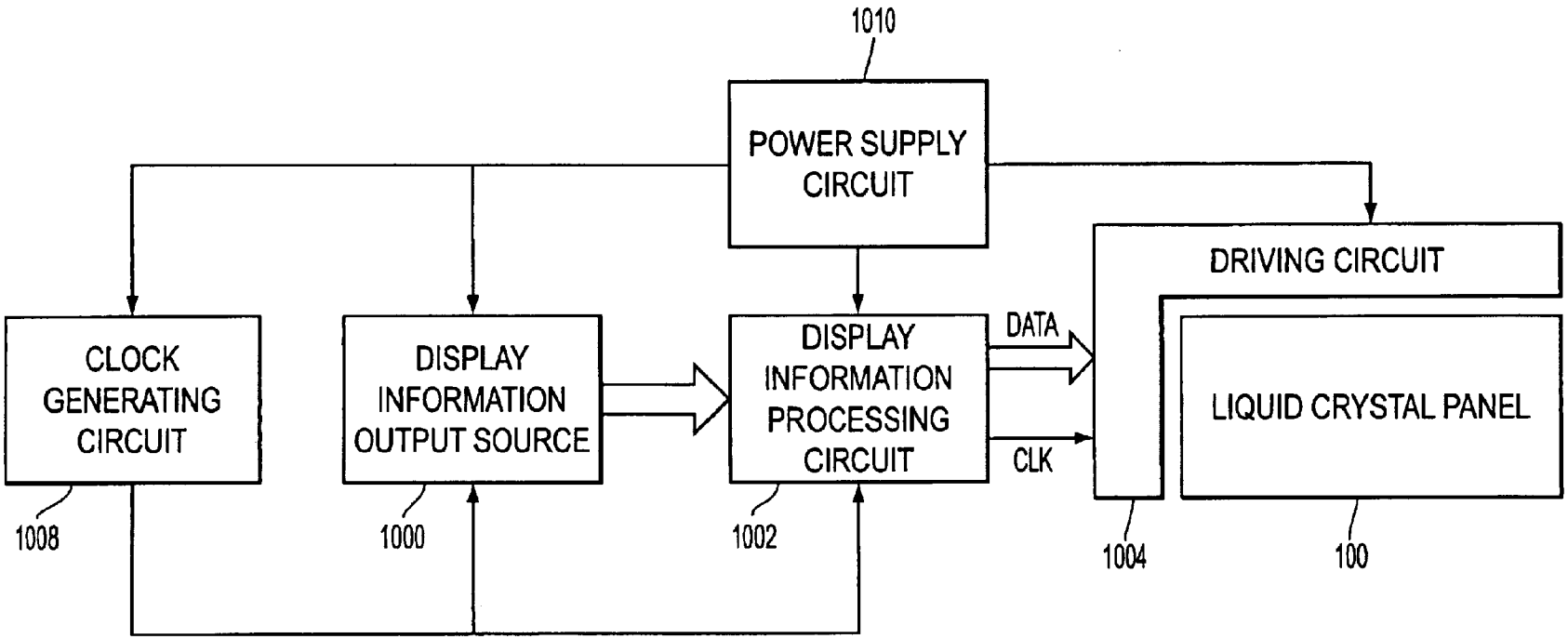
FIG. 16 is a schematic block diagram illustrating the configuration of electronic equipment to which a display device is applied.

Next, an example of applying the aforementioned display apparatus to portable electronic equipment is described hereinbelow. In this case, as illustrated in FIG. 16, the electronic equipment is composed mainly of a display information output source 1000, a display information processing circuit 1002, a driving circuit 1004, a liquid crystal panel 100, a clock generating circuit 1008, and a power supply circuit 1010. Among these constituent elements, the display information output source 1000 includes memories, such as a ROM (Read-only Memory) and a RAM (Random Access Memory), a storage unit, such as an optical disk unit, and a tuning circuit for turning image signals and outputting the tuned image signals. The output source 1000 outputs display information, which is represented by image signals of a predetermined format, to the display information processing circuit 1002 according to clock signals outputted from the clock generating circuit 1008. Further, the display information processing circuit 1002 is a host device including the control circuit 400 of FIG. 1. This circuit 1002 further includes various processing circuits, such as a serial-parallel conversion circuit, an amplification/polarity-inversion circuit, a rotation circuit, a gamma correction circuit, and a clamp circuit, and serially generates digital signals from display information inputted according to the clock signals CLK. Further, the circuit 1002 outputs the digital signals to the driving circuit 1004 together with the timing signals, such as the clock signal, and the control signals. Furthermore, the driving circuit 1004 corresponds to the combination of the data line driving circuit 250, the scanning line driving circuit 350 and the control circuit 400, and includes an inspection circuit used for inspection in the manufacturing process. The power supply circuit 1010 supplies predetermined electric power to each of these circuits, and conceptually includes the aforementioned drive voltage generating circuit 500.

<Hand-portable Telephone Set>

Figure 17:
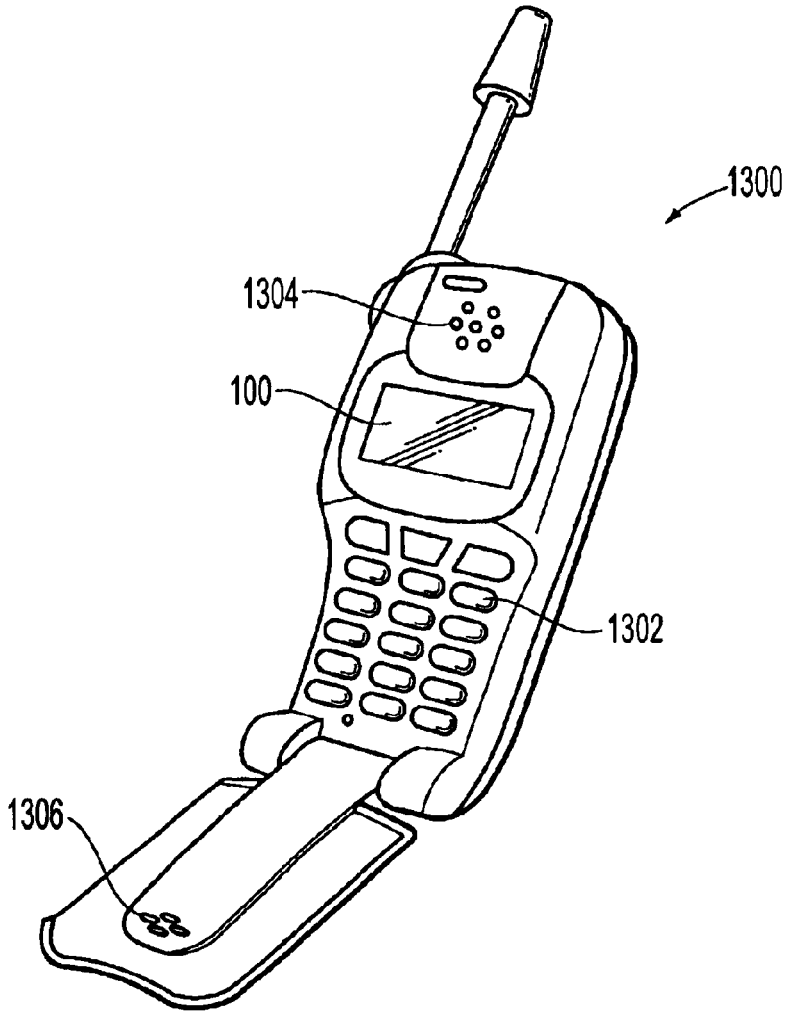
FIG. 17 is a perspective diagram illustrating the configuration of a portable telephone set that is an example of the electronic equipment to which the display device is applied.

Next, an example of applying the aforementioned display apparatus to a hand-portable telephone set is described hereunder. FIG. 17 is a perspective diagram illustrating the configuration of this hand-portable telephone set. As illustrated in this figure, the hand-portable telephone set 1300 has a liquid crystal panel 100 in addition to a plurality of operating buttons 1302, an earpiece 1304, and a mouthpiece 1306. In this liquid crystal panel 100, a full-screen display operation using all region as a display region is performed at reception or transmission. In contrast, when waiting for an incoming call, a partial display operation using only an area on which necessary information on electric field strength, numbers, and characters is indicated, as a display region, is performed in this liquid crystal panel 100. Thus, the power consumption in the display apparatus when waiting for an incoming call is suppressed. Consequently, the length of a time period during which the telephone set can wait for incoming calls is increased to a long time period.

Incidentally, the electronic equipment to which the display apparatus of the present invention is applied is sometimes required to perform a full-screen display operation on the display apparatus, and can perform a display operation by using a partial region in other cases, and is strongly requested to reduce power consumption. Preferably, such electronic equipment is, for example, the aforementioned hand-portable telephone set, a pager, a timepiece, or a PDA (Personal Digital Assistant). Additionally, the display apparatus of the present invention can be applied to other devices, such as a liquid crystal television, a view-finder type or direct-view-type camcorder, a car navigation device, an electric calculator, a word processor, a workstation, a TV phone, a POS terminal, and a device having a touch panel.

Advantages

As above described, the present invention enables a display device to suppress an occurrence of degradation in the quality of picture, to enhance the resolution thereof, to reduce the power consumption thereof, and to simplify the configuration thereof.

What is claimed is:

1. A method of driving a matrix type display apparatus for driving a pixel provided corresponding to each of intersections between a plurality of scanning lines and a plurality of data lines by a switching device, wherein when only a first region including a part of said plurality of scanning lines is put into a display state while a second region including the rest of said plurality of scanning lines is put into a non-display state, a non-selection signal, in response to which said switching device is brought into a non-conducting state, is supplied to each of said scanning lines of said second region by inverting a polarity of a signal voltage every one or more vertical scanning time period, by using an intermediate value, which is represented by a signal supplied to said data lines, as a reference.

2. The method of driving a matrix type display apparatus according to claim 1, wherein a selection signal, which puts said switching device into a conducting state, is supplied in one of time periods into which a horizontal scanning time period is divided, and the non-selection signal, which puts said switching device into the non-conducting state, is supplied in the remaining ones of the time periods by inverting a polarity of a signal voltage every predetermined time period, by using the intermediate value, which is represented by the signal supplied to the data line as a reference.

3. The method of driving a matrix type display apparatus according to claim 1, wherein the selection signal is supplied to each of said scanning lines before said second region is put into the non-display state.

4. A method of driving a matrix type display apparatus for driving a pixel provided corresponding to each of intersections between a plurality of scanning lines and a plurality of data lines by a switching device, wherein in a case that only a first region including a part of said plurality of scanning lines is put into a display state while a second region including the rest of said plurality of scanning lines is put into a non-display state, when a scanning line in said second region is selected, a signal having a positive-side voltage level and a negative-side voltage level, which are determined by using an intermediate value represented by a signal to be supplied to the data lines as a reference, is supplied to each of said scanning lines by inverting a polarity of a signal voltage every one or more vertical scanning time period, by using the intermediate value as a reference.

5. The method of driving a matrix type display apparatus according to claim 4, wherein a polarity inverting period of the positive-side voltage level and the negative-side voltage level at a time of selecting said scanning lines of said second region is a time period whose length is obtained by multiplying a length of a horizontal scanning time period by a value approximately equal to a quotient of a number of the scanning lines of said second region by an integer that is equal to or larger than 2.

6. The method of driving a matrix type display apparatus according to claim 4, wherein when said scanning line of said first region is selected, signals relatively having the positive-side voltage level and the negative-side voltage level are alternately supplied to each of said data lines, in a time period, in which a selection signal putting said switching device into a conducting state is supplied, and a time period in which a non-selection signal putting said switching device into a non-conducting state is supplied, of one horizontal scanning time period correspondingly to a polarity of a voltage represented by the selection signal, which is determined by using said intermediate value as a reference.

7. The method of driving a matrix type display apparatus according to claim 4, wherein when said scanning line of said second region is selected before said second region is put into a non-display state, a signal for putting said second region into an off display condition is supplied thereto.

8. A matrix type display apparatus for driving a pixel provided corresponding to each of intersections between a plurality of scanning lines and a plurality of data lines by a switching device, said matrix type display apparatus comprising:

a scanning line driving circuit that supplies a selection signal, in response to which said switching device is put into a conducting state, in one of time periods to which a horizontal scanning time period is divided, and a non-selection signal, in response to which said switching device is brought into a non-conducting state, in remaining time periods to each of said scanning lines of a second region by inverting a polarity of a signal voltage every predetermined time period, using an intermediate value represented by a signal supplied to said data lines, as a reference, when only a first region including a first part of said plurality of scanning lines is put into a display state while said second region including remaining part of said plurality of scanning lines is put into a non-display state, and that supplies the non-selection signal to each of said scanning lines of said second region by inverting a polarity of a signal voltage every one or more vertical scanning time period, using said intermediate value represented by the signal supplied to said data lines, as a reference; and a data line driving circuit that alternately supplies, when said scanning line of said first region is selected, signals relatively having a positive-side voltage level and a negative-side voltage level, which are determined by using said intermediate value as a reference, in a time period in which the selection signal is supplied, and a time period in which the non-selection signal is supplied, of a horizontal scanning time period correspondingly to a polarity of a voltage represented by the selection signal determined by using said intermediate value as a reference, and that supplies, when said scanning line of said second region is selected, signals relatively having the positive-side voltage level and the negative positive level, determined by using the intermediate value as a reference, by inverting the polarity of a signal voltage every one or more horizontal scanning time periods.

9. The matrix type display apparatus according to claim 8, wherein said scanning line driving circuit alternately inverts polarities of voltages represented by the selection signals respectively supplied to adjacent ones of said scanning lines.

10. The matrix type display apparatus according to claim 8, wherein said scanning line driving circuit supplies the selection signal to each of said scanning lines before said second region is put into a non-display state, and wherein when the scanning line of said second region is selected, said data line driving circuit supplies a signal putting said second region into an off display condition.

11. The matrix type display apparatus according to claim 8, wherein said data line driving circuit has a memory for storing display data to be respectively displayed at said pixels, and wherein when said scanning line of said first region is selected, said data line driving circuit reads the display data from said memory, and generates signals respectively having the positive-side voltage level and the negative-side voltage level according to the display data, and wherein when said scanning line of said second region is selected, said data line driving circuit stops reading display data from said memory.

12. The matrix type display apparatus according to claim 8, which further comprises a gray scale level control signal generating circuit for generating a gray scale level control signal, wherein when said scanning line of said first region is selected, said data line driving circuit supplies display data to pixels placed on said scanning line by modulating the display data so that the modulated display data corresponds to a gray scale level at which data is displayed, at each of said pixels, according to timing provided by the gray scale level control signal, and wherein when said scanning line of said second region is selected, said gray scale level control signal generating circuit stops generation of a gray scale level control signal, and said data line driving circuit stops modulation of the display data.

13. The matrix type display apparatus according to one of claims 8 to 12, wherein said switching device is a two-terminal switching device, wherein an electro-optical material is sandwiched between a pair of substrates, wherein each of said pixels is constituted by series-connecting said two-terminal switching device and said electro-optical material between said plurality of scanning lines provided on one of said pair of substrates and said plurality of data lines.

14. The matrix type display apparatus according to claim 13, wherein said two-terminal switching device has a conductor/insulator/conductor structure connected to said scanning line or said data line.

15. Electronic equipment comprising said matrix type display apparatus according to one of claims 8 to 14.

* * * * *